US005202036A

United States Patent [19]

Ripple et al.

[11] Patent Number: 5,202,036

[45] Date of Patent: Apr. 13, 1993

[54] DIESEL LUBRICANTS AND METHODS

[75] Inventors: David E. Ripple, Kirtland; Jack L. Karn, Richmond Heights; Daniel M. Vargo, Willoughby, all of Ohio

[73] Assignee: The Lubrizol Corporation, Wickliffe, Ohio

[21] Appl. No.: 890,410

[22] Filed: May 29, 1992

Related U.S. Application Data

[63] Continuation-in-part of Ser. No. 545,376, Jun. 28, 1990.

[51] Int. Cl.[5] ..... C10M 141/06

[52] U.S. Cl. ..... 252/33.4; 252/51.5 A; 252/49.6; 252/32.7 E

[58] Field of Search ..... 252/33.6, 51.5 A, 33.4, 252/32.7 E

[56] References Cited

U.S. PATENT DOCUMENTS 4,234,435 11/1980 Meinhardt et al. ..... 252/51.5 A
4,283,294 8/1981 Clarke ..... 252/32.7 R

*Primary Examiner*—Jacqueline Howard
*Attorney, Agent, or Firm*—Frederick D. Hunter; John H. Engelmann; James A. Cairns

[57] ABSTRACT

A diesel lubricant exhibiting improved ability to minimize undesirable viscosity increases when used in diesel engines is described. More particularly, in accordance with the present invention, a diesel lubricant is described which comprises a major amount of an oil of lubricating viscosity and a minor amount, sufficient to minimize undesirable viscosity increases of the lubricant when used in diesel engines, of a composition comprising (A) at least one carboxylic derivative composition produced by reacting at least one substituted succinic acylating agent with at least one amino compound containing at least one —NH— group wherein said acylating agent consists of substituent groups and succinic groups wherein the substituent groups are derived from polyalkene characterized by an Mn value of at least about 1200 and an Mw/Mn ratio of at least about 1.5, and wherein said acylating agents are characterized by the presence within their structure of an average of at least about 1.3 succinic groups for each equivalent weight of substituent groups, and (B) at least one basic alkali or alkaline earth metal salt of at least one acidic organic compound having a metal ratio of at least about 2. The composition should have a TBN in the range of about 6 to about 15, with the sucinnic acid derivative contributing about 0.5 to 1.5 TBN to the composition. The alkali or alkaline earth metal salts (detergents) should contribute the rest of the TBN of the composition. TBN is measured by the ASTM D2896 method. Magnesium should contribute less than about 30% of the total TBN of the composition. The invention also includes methods for operating diesel engines which comprises lubricating said engines during operation with the diesel lubricants of the invention.

37 Claims, No Drawings

DIESEL LUBRICANTS AND METHODS

This application is a continuation-in-part of Ser. No. 07/545,376, filed Jun. 28, 1990.

BACKGROUND OF THE INVENTION

The present invention relates to diesel lubricants, and more particularly to diesel lubricants containing additives which are effective to minimize undesirable viscosity increases of the lubricant when the lubricant is used in diesel engines. The invention also relates to methods of preparing basic alkali and alkaline earth metal sulfonates, and a method of operating diesel engines which comprises lubricating said engines during operation with the diesel lubricants of the invention.

It is well known that lubricating oils tend to deteriorate under conditions of use in present day internal combustion engines resulting in the formation of sludge, lacquer, carbonaceous materials and resinous materials which tend to adhere to the various engine parts, in particular, the engine rings, grooves and skirts.

Furthermore, diesel engines operated at low-speed and high-torque such as under prolonged idle and stop-and-go conditions have experienced extensive and undesirable thickening of the lubricant. It has been suggested in the prior art that the undesirable thickening of the oil is caused by the high levels of insolubles (soot).

One class of compounds which has been suggested for use in lubricating oils, particularly diesel oils, are the normal and overbased sulfurized calcium alkyl phenolates such as described in U.S. Pat. Nos. 3,474,035; 3,528,917; and 3,706,632. These materials function as detergents and dispersants, and also are reported to exhibit antioxidant and anti- thickening properties. Another multi-purpose additive for lubricating oils having antioxidant, anti-thickening, anti-corrosion and detergent properties is described in U.S. Pat. No. 3,897,352. The additive described in this patent comprises a sulfurized, Group II metal nitrated alkyl phenolate.

As will be described more fully hereinafter, the present invention relates to a diesel lubricant containing certain specified types of carboxylic derivative compositions as dispersants, certain basic alkali and alkaline earth metal salts, acting as detergents. This combination of specific dispersant, and detergent, is effective to minimize undesirable viscosity increases of diesel lubricants when used in diesel engines.

Lubricating oil formulations containing oil-soluble carboxylic acid derivatives, and in particular, those obtained by the reaction of a carboxylic acid with an amino compound have been described previously such as in U.S. Pat. Nos. 3,018,250; 3,024,195; 3,172,892; 3,216,936; 3,219,666; and 3,272,746. Many of the above-identified patents also describe the use of such carboxylic acid derivatives in lubricating oils in combination with ash containing detergents including basic metal salts of acidic organic materials such as sulfonic acids, carboxylic acids, etc.

The particular type of carboxylic acid derivative composition utilized in the diesel lubricant of the present invention are described generally in U.S. Pat. No. 4,234,435. This patent also describes lubricating compositions containing said carboxylic acid derivative compositions in combination with other additives such as fluidity modifiers, auxiliary detergents and dispersants of the ash producing or ashless type, oxidation inhibitors, etc. A lubricating composition containing the carboxylic acid derivative, a basic calcium sulfonate, and other traditional additives is described in the '435 patent in Col. 52, lines 1–8.

The second critical component of the diesel lubricants of the present invention is at least one basic alkali or alkaline earth metal salt of at least one acidic organic compound having a metal ratio of at least about 2. Such compositions generally are referred to in the art as metallic or ash-detergents, and the use of such detergents in the lubricating oil formulations has been suggested in many prior art patents. For example, Canadian Patent 1,055,700 describes the use of basic alkali sulfonate dispersions in crankcase lubricants for both spark-ignited and compression-ignited internal combustion engines. The Canadian patent suggests that the basic alkali sulfonate dispersions can be used alone or in combination with other lubricant additives known in the art such as ashless dispersants including esters or amides of hydrocarbon substituted succinic acids.

Even though detergents and dispersants, both of the ash and the ashless-type have been utilized previously in diesel lubricants, many of these lubricants have continued to exhibit undesirable thickening, especially under low-speed, high-torque operation unless relatively large amounts of the detergents and dispersants are incorporated into the diesel lubricants. The use of large amounts of detergents and dispersants generally is undesirable because of the added cost.

In order to constitute an acceptable heavy duty diesel lubricant, a lubricant must demonstrate passing performance in standard tests. Three such tests are the Caterpillar 1-G2, a single cylinder high temperature deposit evaluation, the CLR L-38, demonstrating copper/lead bearing protection and the Mack T-7. Acceptable performance in the first two tests is required for an API CD quality rating. However, neither of these two tests measures the lubricants ability to control viscosity increase. The Mack T-7 test is designed to guage this ability. As set forth more fully below, the Mack T-7 test is conducted with a large diesel engine run at low speed, high torque conditions. This test simulates the conditions which exist when a large diesel truck is just beginning to move and there is a heavy load on the engine. The test oil is placed in the engine, and the engine is run for 150 hours. The viscosity of the oil is monitored over time and the slope of the viscosity increase curve is calculated. A viscosity increase of 0.04 cSt/hour or less over the last 50 hours is considered to be a passing level. There continues to be a need in the industry for compositions which can be added to diesel lubricants which will minimize, if not prevent, undesirable viscosity increase of the lubricant when used in diesel engines, and when formulated into diesel lubricants, the lubricants are capable of achieving the CLR L-38, Caterpillar 1-G2, and Mack T-7 level performance without significantly adding to the cost of the diesel lubricant.

SUMMARY OF THE INVENTION

A diesel lubricant exhibiting improved ability to minimize undesirable viscosity increases when used in diesel engines is described. More particularly, in accordance with the present invention, a diesel lubricant is described which comprises a major amount of an oil of lubricating viscosity and a minor amount, sufficient to minimize undesirable viscosity increases of the lubricant when used in diesel engines, of a composition comprising (A) at least one carboxylic derivative composition produced by reacting at least one substituted succinic acylating agent with at least one amino compound containing at least one —NH— group wherein said acylating agent consists of substituent groups and succinic groups wherein the substituent groups are derived from polyalkene characterized by an Mn value of at least about 1200 and an Mw/Mn ratio of at least about 1.5, and wherein said acylating agents are characterized by the presence within their structure of an average of at least about 1.3 succinic groups for each equivalent weight of substituent groups, (B) at least one basic alkali or alkaline earth metal salt of at least one acidic organic compound having a metal ratio of at least about 2.

The composition should have a TBN in the range of about 6 to about 15, with the succinic acid derivative contributing about 0.5 to 1.5 TBN to the composition. The alkali or alkaline earth metal salts (detergents) should contribute the rest of the TBN of the composition. TBN is measured by the ASTM D2896 method.

Surprisingly, detergents of equal TBN contribution are not equal in effect. The counter ion associated with the organic detergent has a strong influence on the performance of the detergent. The selection of the basic alkali or alkaline earth metal salt (B) contained in the diesel lubricants of the invention should be made carefully. The salts which work best are sodium, potassium and barium. However, barium salts are not the most desirable choices because of potential toxicity. Sodium and potassium are potentially troublesome because in diesel fleet operations, the oil is often analyzed, and traces of sodium or potassium in the oil may be interpreted to be a sign of a coolant leak into the oil. Accordingly, the preferred salt is calcium. Although this salt provide a good level of performance in the present invention, it does not perform as well as the sodium, potassium or barium salts would perform. Magnesium is less effective than calcium. Magnesium should contribute less than about 30% of the total TBN of the composition. Although compositions occassionally function at magnesium levels of 30% or above of the total TBN, they often do not. The preferred acid is a sulfonic acid. The invention also includes methods for operating diesel engines which comprise lubricating said engines during operation with the diesel lubricants of the invention.

DESCRIPTION OF THE PREFERRED EMBODIMENTS

The present invention relates to diesel engine lubricants which provide a low rate of viscosity increase. Although the mechanism by which the sump oil in diesel engines increases in viscosity with time is not fully understood, it does appear to be likely that the small soot particles which diesel engines produce are involved in the process. During operation, a diesel engine produces soot particles. Some of these particles come out in the exhaust and produce the well known clouds of black smoke which are the hallmark of large diesel trucks. However, some of the soot particles are entrained in the engine lubricating oil. These soot particles in the oil are thought to cause viscosity increase. The longer the engine is run, the more soot which accumulates in the oil. Possibly, there is a relationship between the amount of soot in the oil, and the degree of thickening observed. Whatever the mechanism may be, it is commonly observed that the oil in a diesel engine becomes thicker as the engine is run. This effect is illustrated by EXAMPLE 1 in which an ordinary oil with average levels of detergents is subjected to the Mack T-7 test. The slope of the viscosity increase is 0.16 cSt/hr.

Dispersants can help to control the viscosity increase. However, as can be seen from EXAMPLE 1 this level of dispersants alone, does not do the job. Detergents can also help to control viscosity increase, although once again, it can be seen from EXAMPLE 1 that this level of detergents is not adequate to accomplish the goal. The akalinity present in the overbased detergents seems to help control viscosity increase. However, detergents are not equal in their ability to control viscosity increase. EXAMPLE 2 illustrates the effect of adding detergents to a standard oil formulation. The same amount of detergent, expressed as total base number (TBN) is added in each case. Detergents with different metal ions give different results. It has been found that potassium, sodium and barium give the best results. The results produced by calcium detergents are good, although not as good as those produced by sodium or potassium. Magnesium detergents are less effective, although useable.

The diesel lubricants of the present invention comprise a major amount of an oil of lubricating viscosity and a minor amount, sufficient to minimize undesirable viscosity increases of the lubricant when used in diesel engines, of a composition comprising a combination of (A) an ashless dispersant which comprises at least one carboxylic derivative composition as defined more fully below, (B) an overbased metal containing detergent which comprises at least one basic alkali or alkaline earth metal salt of at least one acidic organic compound. The composition should have a TBN in the range of about 6 to about 15, with the sucinnic acid derivative contributing about 0.5 to 1.5 TBN to the composition. The alkali or alkaline earth metal salts (detergents) should contribute the rest of the TBN of the composition. TBN is measured by the ASTM D2896 method. Magnesium should contribute less than about 30% of the total TBN of the composition. Although compositions occassionally function at magnesium levels of 30% or above of the total TBN, they often do not.

The oil of lubricating viscosity which is utilized in the preparation of the diesel lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butyl- phenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed herein- above can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Component (A) which is utilized in the diesel lubricants of the present invention is at least one carboxylic derivative composition produced by reacting at least one substituted succinic acylating agent with at least one amino compound containing at least one —N—H— group wherein said acylating agent consists of substituent groups and succinic groups wherein the substituent groups are derived from polyalkene characterized by an Mn value of at least about 1200 and an Mw/Mn ratio of at least about 1.5, and wherein said acylating agents are characterized by the presence within their structure of an average of at least about 1.3 succinic groups for each equivalent weight of substituent groups.

The substituted succinic acylating agent utilized the preparation of the carboxylic derivative can be characterized by the presence within its structure of two groups or moieties. The first group or moiety is referred to hereinafter, for convenience, as the "substituent group(s)" and is derived from a polyalkene. The polyalkene from which the substituted groups are derived is characterized by an Mn (number average molecular weight) value of at least 1200 and more generally from about 1500 to about 5000, and an Mw/Mn value of at least about 1.5 and more generally from about 1.5 to about 6. The abbreviation Mw represents the weight average molecular weight. The number average molecular weight and the weight average molecular weight of the polybutenes can be measured by well known techniques of vapor phase osmometry (VPO), membrane osmometry and gel permeation chromatography (GPC). These techniques are well known to those skilled in the art and need not be described herein.

The second group or moiety is referred to herein as the "succinic group(s)". The succinic groups are those groups characterized by the structure

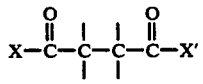

(I)

wherein X and X' are the same or different provided at least one of X and X' is such that the substituted succinic acylating agent can function as carboxylic acylating agents. That is, at least one of X and X' must be such that the substituted acylating agent can form amides or amine salts with, and otherwise function as a conventional carboxylic acid acylating agents. Transesterification and transamidation reactions are considered, for purposes of this invention, as conventional acylating reactions.

Thus, X and/or X' is usually —OH, —O-hydrocarbyl, —O—M+ where M+ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

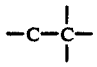

of Formula I forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The substituted succinic acylating agents are characterized by the presence within their structure of 1.3 succinic groups (that is, groups corresponding to Formula I) for each equivalent weight of substituent groups. For purposes of this invention, the number of equivalent weight of substituent groups is deemed to be the number corresponding to the quotient obtained by dividing the Mn value of the polyalkene from which the substituent is derived into the total weight of the substituent groups present in the substituted succinic acylating agents. Thus, if a substituted succinic acylating agent is characterized by a total weight of substituent group of 40,000 and the Mn value for the polyalkene from which the substituent groups are derived is 2000, then that substituted succinic acylating agent is characterized by a total of 20 (40,000/2000=20) equivalent weights of substituent groups. Therefore, that particular succinic acylating agent must also be characterized by the presence within its structure of at least 26 succinic groups to meet one of the requirements of the novel succinic acylating agents of this invention.

Another requirement for the substituted succinic acylating agents within this invention is that the substituent groups must have been derived from a polyalkene characterized by an Mw/Mn value of at least about 1.5.

Polyalkenes having the Mn and Mw values discussed above are known in the art and can be prepared according to conventional procedures. Several such polyalkenes, especially polybutenes, are commercially available.

In one preferred embodiment, the succinic groups will normally correspond to the formula

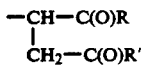

(II)

wherein R and R' are each independently selected from the group consisting of —OH, —Cl, —O-lower alkyl, and when taken together, R and R' are —O—. In the latter case, the succinic group is a succinic anhydride group. All the succinic groups in a particular succinic acylating agent need not be the same, but they can be the same. Preferably, the succinic groups will correspond to

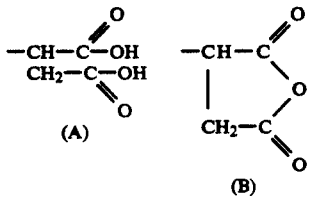

(III)

and mixtures of (III(A)) and (III(B)). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group is 1.3. The maximum number generally will not exceed 6. Preferably the minimum will be 1.4; usually 1.4 to about 6 succinic groups for each equivalent weight of substituent group. A range based on this minimum is at least 1.5 to about 3.5, and more generally about 1.5 to about 2.5 succinic groups per equivalent weight of substituent groups.

From the foregoing, it is clear that the substituted succinic acylating agents of this invention can be represented by the symbol $R_1(R_2)_y$ wherein $R_1$ represents one equivalent weight of substituent group, $R_2$ represents one succinic group corresponding to Formula (I), Formula (II), or Formula (III), as discussed above, and y is a number equal to or greater than 1.3. The more preferred embodiments of the invention could be similarly represented by, for example, letting $R_1$ and $R_2$ represent more preferred substituent groups and succinic groups, respectively, as discussed elsewhere herein and by letting the value of y vary as discussed above.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of Mn for example, a minimum of about 1200 and a maximum of about 5000 are preferred with an Mn value in the range of from about 1300 or 1500 to about 5000 also being preferred. A more preferred Mn value is one in the range of from about 1500 to about 2800. A most preferred range of Mn values is from about 1500 to about 2400. With polybutenes, an especially preferred minimum value for Mn is about 1700 and an especially preferred range of Mn values is from about 1700 to about 2400.

As to the values of the ratio Mw/Mn, there are also several preferred values. A minimum Mw/Mn value of about 1.8 is preferred with a range of values of about 1.8 up to about 3.6 also being preferred. A still more preferred minimum value of Mw/Mn is about 2.0 with a preferred range of values of from about 2.0 to about 3.4 also being a preferred range. An especially preferred minimum value of Mw/Mn is about 2.5 with a range of values of about 2.5 to about 3.2 also being especially preferred.

Before proceeding to a further discussion of the polyalkenes from which the substituent groups are derived, it should be pointed out that these preferred characteristics of the succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of Mn or Mw/Mn. They are intended to be dependent in the sense that, for example, when a preference for a minimum of 1.4 or 1.5 succinic groups is combined with more preferred values of Mn and/or Mw/Mn, the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., $>C{=}CH_2<$); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C{=}CH_2$. However, polymerizable internal olefin monomers (sometimes referred to in the literature as medial olefins) characterized by the presence within their structure of the group

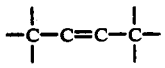

can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

While the polyalkenes from which the substituent groups of the succinic acylating agents are derived generally are hydrocarbon groups such as lower alkoxy, lower alkyl mercapto, hydroxy, mercapto, oxo, as keto and aldehydro groups, nitro, halo, cyano, carboalkoxy, (where alkoxy is usually lower alkoxy), alkanoyloxy, and the like provided the non-hydrocarbon substituents do not substantially interfere with formation of the substituted succinic acid acylating agents of this invention. When present, such non-hydrocarbon groups normally will not contribute more than about 10% by weight of the total weight of the polyalkenes. Since the polyalkene can contain such non-hydrocarbon substituent, it is apparent that the olefin monomers from which the polyalkenes are made can also contain such substituents. Normally, however, as a matter of practicality and expense, the olefin monomers and the polyalkenes will be free from non-hydrocarbon groups, except chloro groups which usually facilitate the formation of the substituted succinic acylating agents of this invention. (As used herein, the term "lower" when used with a chemical group such as in "lower alkyl" or "lower alkoxy" is intended to describe groups having up to 7 carbon atoms).

Although the polyalkenes may include aromatic groups (especially phenyl groups and lower alkyl- and-/or lower alkoxy-substituted phenyl groups such as para-(tert-butyl)phenyl) and cycloaliphatic groups such as would be obtained from polymerizable cyclic olefins or cycloaliphatic substituted-polymerizable acyclic olefins, the polyalkenes usually will be free from such groups. Nevertheless, polyalkenes derived from interpolymers of both 1,3-dienes and styrenes such as butadiene-1,3 and styrene or para-(tert-butyl)styrene are exceptions to this generalization. Again, because aromatic and cycloaliphatic groups can be present, the olefin monomers from which the polyalkenes are prepared can contain aromatic and cycloaliphatic groups.

From what has been described hereinabove in regard to the polyalkene, it is clear that there is a general preference for aliphatic, hydrocarbon polyalkenes free from aromatic and cycloaliphatic groups (other than the diene-styrene interpolymer exception already noted). Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms.

Specific examples of terminal and internal olefin monomers which can be used to prepare the polyalkenes according to conventional, well-known polymerization techniques include ethylene; propylene; butene-1; butene-2; isobutene; pentene-1; hexene-1; heptene-1; octene-1; nonene-1; decene-1; pentene-2; propylene-tetramer; diisobutylene; isobutylene trimer; butadiene-1,2; butadiene-1,3; pentadiene-1,2; pentadiene-1,3; pentadiene-1,4; isoprene; hexadiene-1,5; 2-chloro-butadiene-1,3; 2-methyl-heptene-1; 3-cyclohexylbutene-1; 2-methyl-pentene-1; styrene; 2,4-dichloro styrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene- butadiene-1,3 copolymers, propene-isoprene copolymers, isobutene-chloroprene copolymers, isobutene-(paramethyl)styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3-dimethyl-pentene-1 with hexene-1, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene-1 and 3% of hexene-1; terpolymer of 60% of isobutene with 20% of pentene-1 and 20% of octene-1; copolymer of 80% of hexene-1 and 20% of heptene-1; terpolymer of 90% of isobutene with 2% of cyclohexene and 8% of propylene; and copolymer of 80% of ethylene and 20% of propylene. A preferred source of polyalkenes are the poly(isobutene)s obtained by polymerization of $C_4$ refinery stream having a butene content of about 35 to about 75% by weight and an isobutene content of about 30 to about 60% by weight in the presence of a Lewis acid catalyst such as aluminum trichloride or boron trifluoride. These polybutenes contain predominantly (greater than about 80% of the total repeating units) of isobutene repeating units of the configuration

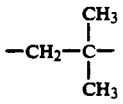

Obviously, preparing polyalkenes as described above which meet the various criteria for Mn and Mw/Mn is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents of this invention, one or more of the above-described polyalkenes is reacted with one or more acidic reactants selected from the group consisting of maleic or fumaric reactants of the general formula $$X(O)C—CH=CH—C(O)X' \quad (IV)$$

wherein X and X' are as defined hereinbefore. Preferably the maleic and fumaric reactants will be one or more compounds corresponding to the formula $$RC(O)—CH=CH—C(O)R' \quad (V)$$

wherein R and R' are as previously defined herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The one or more polyalkenes and one or more maleic or fumaric reactants can be reacted according to any of several known procedures in order to produce the substituted succinic acylating agents of the present invention. Basically, the procedures are analogous to procedures used to prepare the high molecular weight succinic anhydrides and other equivalent succinic acylating analogs thereof except that the polyalkenes (or polyolefins) of the prior art are replaced with the particular polyalkenes described above and the amount of maleic or fumaric reactant used must be such that there is at least 1.3 succinic groups for each equivalent weight of the substituent group in the final substituted succinic acylating agent produced.

For convenience and brevity, the term "maleic reactant" is often used hereafter. When used, it should be understood that the term is generic to acidic reactants selected from maleic and fumaric reactants corresponding to Formulae (IV) and (V) above including a mixture of such reactants.

One procedure for preparing the substituted succinic acylating agents of this invention is illustrated, in part, in U.S. Pat. No. 3,219,666 which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure, for purposes of this invention, is to react the chlorinated polyalkene with the maleic reactant at a temperature usually within the range of about 100° C. to about 200° C. The mole ratio of chlorinated polyalkene to maleic reactant is usually about 1:1. (For purposes of this invention, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the Mn value divided by the average number of chloro groups per molecule of chlorinated polyalkene while the equivalent weight of a maleic reactant is its molecular weight.) Thus, the ratio of chlorinated polyalkene to maleic reactant will normally be such as to provide about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents of the invention utilizes a process described in U.S. Pat. No. 3,912,764 and U.K. Patent 4,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkene. The direct alkylation step is conducted at temperatures of 180° C. to 250° C. During the chlorine-introducing stage, a temperature of 160° C. to 225° C. is employed. In utilizing this process to prepare the substituted succinic acylating agents of this invention, it would be necessary to use sufficient maleic reactant and chlorine to incorporate at least 1.3 succinic groups into the final product for each equivalent weight of polyalkene.

The process presently deemed to be best for preparing the substituted succinic acylating agents utilized in this invention from the standpoint of efficiency, overall economy, and the performance of the acylating agents thus produced, as well as the performance of the derivatives thereof, is the so-called "one-step" process. This process is described in U.S. Pat. Nos. 3,215,707 and 3,231,587. Both are expressly incorporated herein by reference for their teachings in regard to that process.

Basically, the one-step process involves preparing a mixture of the polyalkene and the maleic reactant containing the necessary amounts of both to provide the desired substituted succinic acylating agents of this invention. This means that there must be at least 1.3 moles of maleic reactant for each mole of polyalkene in order that there can be at least 1.3 succinic groups for each equivalent weight of substituent groups. Chlorine is then introduced into the mixture, usually by passing chlorine gas through the mixture with agitation, while maintaining a temperature of at least about 140° C.

A variation on this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° C. and above, there is no need to utilize an additional substantially inert, normally liquid solvent/diluent in the one-step process. However, as explained hereinbefore, if a solvent/diluent is employed, it is preferably one that resists chlorination. Again, the poly- and perchlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including super atmospheric pressure, in order to prevent loss of chlorine so as to maximize chlorine utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160° C. and about 220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200° C. to about 210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

As mentioned previously, the molar ratio of polyalkene to maleic reactant is such that there is at least about 1.3 moles of maleic reactant for each mole of polyalkene. This is necessary in order that there can be at least 1.3 succinic groups per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

A preferred process for preparing the substituted acylating compositions of this invention comprises heating and contacting at a temperature of at least about 140° C. up to the decomposition temperature (A) Polyalkene characterized by Mn value of about 1200 to about 5000 and an Mw/Mn value of about 1.5 to about 4, (B) One or more acidic reactants of the formula $$XC(O)—CH=CH—C(O)X'$$

wherein X and X' are as defined hereinbefore, and (C) Chlorine wherein the mole ratio of (A):(B) is such that there is at least about 1.3 moles of (B) for each mole of (A) wherein the number of moles of (A) is the quotient of the total weight of (A) divided by the value of Mn and the amount of chlorine employed is such as to provide at least about 0.2 mole (preferably at least about 0.5 mole) of chlorine for each mole of (B) to be reacted with (A), said substituted acylating compositions being characterized by the presence within their structure of an average of at least 1.3 groups derived from (B) for each equivalent weight of the substituent groups derived from (A). The substituted acylated compositions as produced by such a process are, likewise, part of this invention.

As will be apparent, it is intended that the immediately preceding description of a preferred process be generic to both the process involving direct alkylation with subsequent chlorination as described in U.S. Pat. No. 3,912,764 and U.K. Patent 1,440,29 and to the completely one-step process described in U.S. Pat. Nos. 3,215,707 and 3,231,587. Thus, said description does not require that the initial mixture of polyalkene and acidic reactant contain all of the acidic reactant ultimately to be incorporated into the substituted acylating composition to be prepared. In other words, all of the acidic reactant can be present initially or only part thereof with subsequent addition of acidic reactant during the course of the reaction. Likewise, a direct alkylation reaction can precede the introduction of chlorine. Normally, however, the original reaction mixture will contain the total amount of polyalkene and acidic reactant to be utilized. Furthermore, the amount of chlorine used will normally be such as to provide about one mole of chlorine for each unreacted mole of (B) present at the time chlorine introduction is commenced. Thus, if the mole ratio of (A):(B) is such that there is about 1.5 moles of (B) for each mole of (A) and if direct alkylation results in half of (B) being incorporated into the product, then the amount of chlorine introduced to complete reaction will be based on the unreacted 0.75 mole of (B); that is, at least about 0.75 mole of chlorine (or an excess as explained above) will then be introduced.

In a more preferred process for preparing the substituted acylating compositions of this invention, there is heated at a temperature of at least about 140° C. a mixture comprising:

(A) Polyalkene characterized by an Mn value of about 1200 to about 5000 and an Mw/Mn value of about 1.3 to about 4, (B) One or more acidic reactants of the formula $$RC(O)—CH=CH—C(O)R'$$

wherein R and R' are as defined above, and (C) Chlorine wherein the mole ratio of (A):(B) is such that there is at least about 1.3 moles of (B) for each mole of (A) where the number of moles of (A) is a quotient of the total weight of (A) divided by the value of Mn, and the amount of chlorine employed is such as to provide at least about one mole of chlorine for each mole of (B) reacted with (A), the substituted acylating compositions being further characterized by the presence within their structure of at least 1.3 groups derived from (B) for each equivalent weight of the substituent groups derived from (A). This process, as described, includes only the one-step process; that is, a process where all of both (A) and (B) are present in the initial reaction mixture. The substituted acylated composition as produced by such a process are, likewise, part of this invention.

The terminology "substituted succinic acylating agent(s)" is used in describing the substituted succinic acylating agents regardless of the process by which they are produced. Obviously, as discussed in more detail hereinbefore, several processes are available for producing the substituted succinic acylating agents. On the other hand, the terminology "substituted acylating composition(s)", is used to describe the reaction mixtures produced by the specific preferred processes described in detail herein. Thus, the identity of particular substituted acylating compositions is dependent upon a particular process of manufacture. It is believed that the novel acylating agents used in this invention can best be described and claimed in the alternative manner inherent in the use of this terminology as thus explained. This is particularly true because, while the products of this invention are clearly substituted succinic acylating agents as defined and discussed above, their structure cannot be represented by a single specific chemical formula. In fact, mixtures of products are inherently present.

With respect to the preferred processes described above, preferences indicated hereinbefore with respect to (a) the substituted succinic acylating agents and (b) the values of Mn, the values of the ratio Mw/Mn, the identity and composition of the polyalkenes, the identity of the acidic reactant (that is, the maleic and/or fumaric reactants), the ratios of reactants, and the reaction temperatures also apply. In like manner, the same preferences apply to the substituted acylated compositions produced by these preferred processes.

For example, such processes wherein the reaction temperature is from about 160° C. to about 220° C. are preferred. Likewise, the use of polyalkenes wherein the polyalkene is a homopolymer or interpolymer of terminal olefins of 2 to about 16 carbon atoms, with the proviso that said interpolymers can optionally contain up to about 40% of the polymer units derived from internal olefins of up to about 16 carbon atoms, constitutes the preferred aspect of the process and compositions prepared by the process. In a more preferred aspect, polyalkenes for use in the process and in preparing the compositions of the process are the homopolymers and interpolymers of terminal olefins of 2 to 6 carbon atoms with the proviso that said interpolymers can optionally contain up to about 25% of polymer units derived from internal olefins of up to about 6 carbon atoms. Especially preferred polyalkenes are polybutenes, ethylene-propylene copolymers, polypropylenes with the polybutenes being particularly preferred.

In the same manner, the succinic group content of the substituted acylating compositions thus produced are preferably the same as that described in regard to the substituted succinic acylating agents. Thus, the substituted acylating compositions characterized by the presence within their structure of an average of at least 1.4 succinic groups derived from (B) for each equivalent weight of the substituent groups derived from (A) are preferred with those containing at least 1.4 up to about 3.5 succinic groups derived from (B) for each equivalent weight of substituent groups derived from (A) being still more preferred. In the same way, those substituted acylating compositions characterized by the presence within their structure of at least 1.5 succinic groups derived from (B) for each equivalent weight of substituent group derived from (A) are still further preferred, while those containing at least 1.5 succinic groups derived from (B) for each equivalent weight of substituent group derived from (A) being especially preferred.

Finally, as with the description of the substituted succinic acylating agents, the substituted acylating compositions produced by the preferred processes wherein the succinic groups derived from (B) correspond to the formula

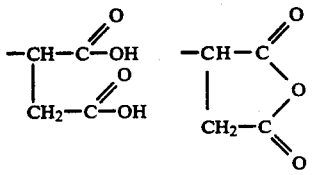

and mixtures of these constitute a preferred class.

An especially preferred process for preparing the substituted acylating compositions comprises heating at a temperature of about 160° C. to about 220° C. a mixture comprising:

(A) Polybutene characterized by an Mn value of about 1700 to about 2400 and an Mw/Mn value of about 2.5 to about 3.2, in which at least 50% of the total units derived from butenes is derived from isobutene, (B) One or more acidic reactants of the formula

RC(O)—CH=CH—C(O)R' wherein R and R' are each —OH or when taken together, R and R' are —O—, and (C) Chlorine wherein the mole ratio of (A):(B) is such that there is at least 1.5 moles of (B) for each mole of (A) and the number of moles of (A) is the quotient of the total weight of (A) divided by the value of Mn, and the amount of chlorine employed is such as to provide at least about one mole of chlorine for each mole of (B) to be reacted with (A), said acylating compositions being characterized by the presence within their structure of an average of at least 1.5 groups derived from (B) for each equivalent weight of the substituent groups derived from (A). In the same manner, substituted acylating compositions produced by such a process constitute a preferred class of such compositions.

For purposes of brevity, the terminology "acylating reagent(s)" is often used hereafter to refer, collectively, to both the substituted succinic acylating agent and to the substituted acylating compositions used in this invention.

The acylating reagents of this invention are intermediates in processes for preparing the carboxylic derivative compositions (A) comprising reacting one or more acylating reagents with an amino compound characterized by the presence within its structure of at least one group.

The amino compound characterized by the presence within its structure of at least one —NH— group can be a monoamine or polyamine compound. For purposes of this invention, hydrazine and substituted hydrazines containing up to three substituents are included as amino compounds suitable for preparing carboxylic derivative compositions. Mixtures of two or more amino compounds can be used in the reaction with one or more acylating reagents of this invention. Preferably, the amino compound contains at least one primary amino group (i.e., —$NH_2$) and more preferably the amine is a polyamine, especially a polyamine containing at least two —NH— groups, either or both of which are primary or secondary amines. The polyamines not only result in carboxylic acid derivative compositions derived from monoamines, but these preferred polyamines result in carboxylic derivative compositions which exhibit more pronounced V.I. improving properties.

The monoamines and polyamines must be characterized by the presence within their structure of at least one —NH— group. Therefore, they have at least one primary (i.e., $H_2N$—) or secondary amino (i.e., H—N=) group. The amines can be aliphatic, cycloaliphatic, aromatic, or heterocyclic, including aliphatic-substituted cycloaliphatic, aliphatic- substituted aromatic, aliphatic-substituted heterocyclic, cycloaliphatic-substituted aliphatic, cycloaliphatic substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated. If unsaturated, the amine will be free from acetylenic unsaturation. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as —$CH_2CH_2$—X—$CH_2CH_2$- where X is —O— or —S—).

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent and the like. The total number of carbon atoms in these aliphatic monoamines will, as mentioned before, normally will not exceed about 40 and usually not exceed about 20 carbon atoms. Specific examples of such monoamines include ethylamine, diethylamine, n-butylamine, di-n-butylammine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic substituted aliphatic amines, include 2-(cyclohexyl)-ethylamine, benzylamine, phenethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(-para-methylphenyl) amine, naphthylamine, N-(n-butyl-)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Polyamines are aliphatic, cycloaliphatic and aromatic polyamines analogous to the above-described monoamines except for the presence within their structure of another amino nitrogen. The other amino nitrogen can be a primary, secondary or tertiary amino nitrogen. Examples of such polyamines include N-aminopropyl-cyclohexylamines, N,N,-di-n-butyl-para-phenylene diamine, bis-(para-aminophenyl) methane, 1,4-diaminocyclohexane, and the like.

Heterocycic mono- and polyamines can also be used in making the carboxylic derivative compositions of this invention. As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkylaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The five- and six-membered heterocyclic rings are preferred.

Among the suitable heterocyclics are aziridines, azetidines, azolidines, tetra- and di-hydro pyridines, pyrroles, indoles, piperidines, imidazoles, di- and tetrahydroimidazoles, piperazines, isoindoles, purines, morpholines, thiomorpholines, N-aminoalkyl-morpholines, N-aminoalkylthiomorpholines, N-aminoalkyl-piperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Hydroxyamines both mono- and polyamines, analogous to those described above are also useful as (a) provided they contain at least one primary or secondary amino group. Hydroxy-substituted amines having only tertiary amino nitrogen such as in tri-hydroxyethyl amine, are thus excluded as (a) (but can be used as (b) as disclosed hereafter). The hydroxy-substituted amines contamplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxypropyl)-amine, N-(hydroxypropyl)-propylamine, N-(2-hydroxyethyl)-cyclohexylamine, 3-hydroxycyclopentylamine, para-hydroxyaniline, N-hydroxyethyl piperazine, and the like.

Hydrazine and substituted-hydrazine can also be used. At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy substituted phenyl or lower alkyl substituted phenyl. Specific examples of substituted hydrazines are methylhydrazine, N,N-dimethyl-hydrazine, N,N'-dimethylhydrazine, phenylhydrazine, N-phenyl-N,-ethylhydrazine, N-(para-tolyl)-N'-(n-butyl)-hydrazine, N-(para-nitrophenyl)-hydrazine, N-(para-nitrophenyl)-N-methylhydrazine, N,N'-di(para-chlorophenol)-hydrazine, N-phenyl-N'-cyclohexylhydrazine, and the like.

The high molecular weight hydrocarbyl amines, both mono-amines and polyamines, which can be used as (a) are generally prepared by reacting a chlorinated polyolefin having a molecular weight of at least about 400 with ammonia or amine. Such amines are known in the art and described, for example, in U.S. Pat. Nos. 3,275,554 and 3,438,757, both of which are expressly incorporated herein by reference for their disclosure in regard to how to prepare these amines. All that is required for use of these amines is that they possess at least one primary or secondary amino group.

Another group of amines suitable for use are branched polyalkylene polyamines. The branched polyalkylene polyamines are polyalkylene polyamines wherein the branched group is a side chain containing on the average at least one nitrogen-bonded aminoalkylene

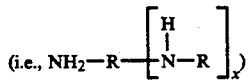

group per nine amino units present on the main chain, for example, 1–4 of such branched chains per nine units on the main chain units. Thus, these polyamines contain at least three primary amino groups and at least one tertiary amino group.

Suitable amines also include polyoxyalkylene polyamines, e.g., polyoxyalkylene diamines and polyoxyalkylene triamines, having average molecular weights ranging from about 200 to 4000 and preferably from about 400 to 2000. Illustrative examples of these polyoxyalkylene polyamines may be characterized by the formulae

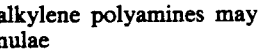

(VI)

wherein m has a value of about 3 to 70 and preferably about 10 to 35.

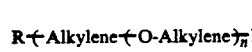

(VII)

wherein n is such that the total value is from about 1 to 40 with the proviso that the sum of all of the n's is from about 3 to about 70 and generally from about 6 to about 35 and R is a polyvalent saturated hydrocarbon radical of up to 10 carbon atoms having a valence of 3 to 6. The alkylene groups may be straight or branched chains and contain from 1 to 7 carbon atoms and usually from 1 to 4 carbon atoms. The various alkylene groups present within Formulae (VI) and (VII) may be the same or different.

The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403, etc.".

U.S. Pat. Nos. 3,804,763 and 3,948,800 are expressly incorporated herein by reference for their disclosure of such polyoxyalkylene polyamines and process for acylating them with carboxylic acid acylating agents which processes can be applied to their reaction with the acylating reagents of this invention.

The most preferred amines are the alkylene polyamines, including the polyalkylene polyamines, as described in more detail hereafter. The alkylene polyamines include those conforming to the formula

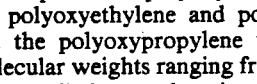

(VIII)

wherein n is from 1 to about 10; each $R^3$ is independently a hydrogen atom, a hydrocarbyl group or a hydroxy-substituted hydrocarbyl group having up to about 30 atoms, with the proviso that at least one $R^3$ group is a hydrogen atom and u is an alkylene group of about 2 to about 10 carbon atoms. Preferably u is ethylene or propylene. Especially preferred are the alkylene polyamines where each $R^3$ is hydrogen with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the carboxylic derivative compositions include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylenehexamine, di(-trimethylene)triamine, N-(2-aminoethyl)piperazine, 1,4-bis(2,aminoethyl)piperazine, and the like. Higher homologs as are obtained by condensing two or more of the above-illustrated alkylene amines are useful as (a) as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful in preparing novel nitrogen-containing compositions of matter of this invention. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than one percent (by weight) material boiling below about 200° C. In the instance of ethylene polyamine bottoms, which are readily available and found to be quite useful, the bottoms contain less than about two percent (by weight) total diethylene triamine (DETA) or triethylene tetramine (TETA). A typical sample of such ethylene polyamine bottoms obtained from the Dow Chemical Company of Freeport, Texas designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Hydroxylalkyl alkylene polyamines having one or more hydroxyalkyl substituents on the nitrogen atoms, are also useful in preparing derivatives of the aforedescribed olefinic carboxylic acids. Preferred hydroxylalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl)ethylene diamine,N,N-bis(2-hydroxyethyl)ethylene diamine, 1-(2-hydroxyethyl) piperazine, monohydroxypropyl-substituted diethylene triamine, dihydroxypropyl-substituted tetraethylene pentamine, N-(2-hydroxybutyl)tetramethylene diamine, etc. Higher homologs as are obtained by condensation of the above-illustrated hydroxy alkylene polyamines through amino radicals or through hydroxy radicals are likewise useful as (a). Condensation through amino radicals results in a higher amine accompanied by removal of ammonia and condensation through the hydroxy radicals results in products containing ether linkages accompanied by removal of water.

The carboxylic derivative compositions (A) produced from the acylating reagents and the amino compounds described hereinbefore produce acylated amines which include amine salts, amides, imides and imidazolines as well as mixtures thereof. To prepare carboxylic acid derivatives from the acylating reagents and the amino compounds, one or more acylating reagents and one or more amino compounds are heated, optionally in the presence of a normally liquid, substantially inert organic liquid solvent/diluent, at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amino compound are reacted in amounts sufficient to provide from about one-half equivalent to about 2 moles of amino compound per equivalent of acylating reagent. For purposes of this invention an equivalent of amino compound is that amount of the amino compound corresponding to the total weight of amino compound divided by the total number of nitrogens present. Thus, octylamine has an equivalent weight equal to its molecular weight; ethylene diamine has an equivalent weight equal to one-half its molecular weight; and aminoethylpiperazine has an equivalent weight equal to one-third its molecular weight.

The numbers of equivalents of acylating reagent depends on the number of carboxylic functions (e.g., —C(O)X, —C(O)X', —C(O)R, and —C(O)R', wherein X, X', R and R' are as defined above) present in the acylating reagent. Thus, the number of equivalents of acylating reagents will vary with the number of succinic groups present therein. In determining the number of equivalents of acylating reagents, those carboxyl functions which are not capable of reacting as a carboxylic acid acylating agent are excluded. In general, however, there are two equivalents of acylating reagent for each succinic group in the acylating reagents or, from another viewpoint, two equivalents for each group in the acylating reagents derived from (B); i.e., the maleic reactant from which the acylating reagent is prepared. Conventional techniques are readily available for determining the number of carboxyl functions (e.g., acid number, saponification number) and, thus, the number of equivalents of acylating reagent available to react with amine.

Because the acylating reagents can be used in the same manner as the high molecular weight acylating agents of the prior art in preparing acylated amines suitable for use as component (A) in the diesel lubricants of this invention, U.S. Pat. Nos. 3,172,892; 3,219,666; 3,272,746; and 4,234,435 are expressly incorporated herein by reference for their disclosure with respect to the procedures applicable to reacting the acylating reagents with the amino compounds as described above. In applying the disclosures of these patents to the acylating reagents, the latter can be substituted for the high molecular weight carboxylic acid acylating agents disclosed in these patents on an equivalent basis. That is, where one equivalent of the high molecular weight carboxylic acylating agent disclosed in these incorporated patents is utilized, one equivalent of the acylating reagent of this invention can be used.

In order to produce carboxylic derivative compositions exhibiting viscosity index improving capabilities, it has been found generally necessary to react the acylating reagents with polyfunctional reactants. For example, polyamines having two or more primary and/or secondary amino groups are preferred. It is believed that the polyfunctional reactants serve to provide "bridges" or cross-linking in the carboxylic derivative compositions and this, in turn, is somehow responsible for the viscosity index-improving properties. However, the mechanism by which viscosity index improving properties is obtained is not understood and there is no intention to be bound by this theory.

Obviously, however, it is not necessary that all of the amino compound reacted with the acylating reagents be polyfunctional. Thus, combinations of mono- and polyfunctional amino compounds be used.

While the parameters have not been fully determined as yet, it is believed that acylating reagents of this invention should be reacted with amino compounds which contain sufficient polyfunctional reactant, (e.g., polyamine) so that at least about 25% of the total number of carboxyl groups (from the succinic groups or from the groups derived from the maleic reactant) are reacted with a polyfunctional reactant. Better results, insofar as the viscosity index-improving facilities of the carboxylic derivative compositions is concerned, appear to be obtained when at least 50% of the carboxyl groups are involved in reaction with such polyfunctional reactants. In most instances, the best viscosity index improving properties seem to be achieved when the acylating reagents of this invention are reacted with a sufficient amount of polyamine to react with at least about 75% of the carboxyl group. It should be understood that the foregoing percentages are "theoretical" in the sense that it is not required that the stated percentage of carboxyl functions actually react with polyfunctional reactant. Rather these percentages are used to characterize the amounts of polyfunctional reactants desirably "available" to react with the acylating reagents in order to achieve the desired viscosity index improving properties.

Another optional aspect of this invention involves the post-treatment of the carboxylic derivative compositions (A). The process for post- treating the carboxylic acid derivative compositions is again analogous to the post-treating processes used with respect to similar derivatives of the high molecular weight carboxylic acid acylating agents of the prior art. Accordingly, the same reaction conditions, ratio of reactants and the like can be used.

Acylated nitrogen compositions prepared by reacting the acylating reagents with an amino compound as described above are post-treated by contacting the acylated nitrogen compositions thus formed (e.g., the carboxylic derivative compositions) with one or more post-treating reagents selected from the group consisting of boron oxide, boron oxide hydrate, boron halides, boron acids, esters of boron acids, carbon disulfide, sulfur, sulfur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds plus phenols, and sulfur plus phenols.

Since post-treating processes involving the use of these posttreating reagents are known insofar as application to reaction products of high molecular weight carboxylic acid acylating agents of the prior art and amines and/or alcohols, detailed descriptions of these processes herein are unnecessary. In order to apply the prior art processes to the carboxylic derivative compositions of this invention, all that is necessary is that reaction conditions, ratio of reactants, and the like as described in the prior art, be applied to the carboxylic derivative compositions (A). In particular, U.S. Pat. No. 4,234,435 is expressly incorporated by reference for its disclosure of post-treating processes and post-treating reagents applicable to the carboxylic derivative compositions (A). The following U.S. patents also describe post-treating processes and post-treating reagents applicable to the carboxylic derivative compositions (A): U.S. Pat. Nos. 3,200,107; 3,254,025; 3,256,185; 3,282,955; 3,284,410; 3,366,569; 3,403,102; 3,428,561; 3,502,677; 3,639,242; 3,708,522; 3,865,813; 3,865,740; 3,954;639.

The preparation of the acylating agents and the carboxylic acid derivative compositions (A), as well as the post-treated carboxylic acid derivative compositions is illustrated by the following examples. These examples illustrate presently preferred embodiments. In the following examples, and elsewhere in the specification and claims, all percentages and parts are by weight unless otherwise clearly indicated.

EXAMPLE A-1

A mixture of 510 parts (0.28 mole) of polyisobutene (Mn=1845; Mw=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

EXAMPLE A-2

A mixture of 1000 parts (0.495 mole) of polyisobutene (Mn-2020; Mw=6049) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C. an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

EXAMPLE A-3

A mixture of 3251 parts of polyisobutene chloride, prepared by the addition of 251 parts of gaseous chlorine to 3000 parts of polyisobutene (Mn=1696; Mw=6594) at 80° C. in 4.66 hours, and 345 parts of maleic anhydride is heated to 200° C. in 0.5 hour. The reaction mixture is held at 200°-224° C. for 6.33 hours, stripped at 210° C. under vacuum and filtered. The filtrate is the desired polyisobutene-substituted succinic acylating agent having a saponification equivalent number of 94 as determined by ASTM procedure D-94.

EXAMPLE A-4

A mixture of 3000 parts (1.63 moles) of polyisobutene (Mn=1845; MW=5325) and 344 parts (3.51 moles) of maleic anhydride is heated to 140° C. This mixture is heated to 201° C in. 5.5 hours during which 312 parts (4.39 moles) of gaseous chlorine is added beneath the surface. The reaction mixture is heated at 201°-236° C. with nitrogen blowing for 2 hours and stripped under vacuum at 203° C. The reaction mixture is filtered to yield the filtrate as the desired polyisobutene-substituted succinic acylating agent having a saponification equivalent number of 92 as determined by ASTM procedure D-94.

EXAMPLE A-5

A mixture of 3000 parts (1.49 moles) of polyisobutene (Mn=2020; Mw=6049) and 364 parts (3.71 moles) of maleic anhydride is heated at 220° C. for 8 hours. The reaction mixture is cooled to 170° C. At 170°-190° C., 105 parts (1.48 moles) of gaseous chlorine is added beneath the surface in 8 hours. The reaction mixture is heated at 190° C. with nitrogen blowing for 2 hours and then stripped under vacuum at 190° C. The reaction mixture is filtered to yield the filtrate as the desired polyisobutene-substituted succinic acylating agent.

EXAMPLE A-6

A mixture of 800 parts of a polyisobutene falling within the scope of the claims of the present invention and having an Mn of about 2000, 646 parts of mineral oil and 87 parts of maleic anhydride is heated to 179° C. in 2.3 hours. At 176°-180° C., 100 parts of gaseous chlorine is added beneath the surface over a 19-hour period. The reaction mixture is stripped by blowing with nitrogen for 0.5 hour at 180° C. The residue is an oil-containing solution of the desired polyisobutene-substituted succinic acylating agent.

EXAMPLE A-7

The procedure for Example A-1 is repeated except the polyisobutene (Mn=1845; Mw=5325) is replaced on an equimolar basis by polyisobutene (Mn=1457; Mw=5808).

EXAMPLE A-8

The procedure for Example A-1 is repeated except the polyisobutene (Mn=1845; Mw=5325) is replaced on an equimolar basis by polyisobutene (Mn=2510; Mw=5793).

EXAMPLE A-9

The procedure for Example A-1 is repeated except the polyisobutene (Mn=1845; Mw=5325) is replaced on an equimolar basis by polyisobutene (Mn=3220; Mw=5660).

EXAMPLE A-10

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent prepared in Example A-1 at 138° C. The reaction mixture is heated to 150° C. in 2 hours and stripped by blowing with nitrogen. The reaction mixture is filtered to yield the filtrate as an oil solution of the desired product.

EXAMPLE A-11

A mixture is prepared by the addition of 57 parts (1.38 equivalents) of a commercial mixture of ethylene polyamines having from about 3 to 10 nitrogen atoms per molecule to 1067 parts of mineral oil and 893 parts (1.38 equivalents) of the substituted succinic acylating agent prepared in Example A-2 at 140°-145° C. The reaction mixture is heated to 155° C. in 3 hours and stripped by blowing with nitrogen. The reaction mixture is filtered to yield the filtrate as an oil solution of the desired product.

EXAMPLE A-12

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the substituted succinic acylating agent prepared in Example A-2 at 140° C. The reaction mixture is heated to 150° C. in 1.8 hours and stripped by blowing with nitrogen. The reaction mixture is filtered to yield the filtrate as an oil solution of the desired product.

EXAMPLE A-13

A mixture is prepared by the addition of 5500 parts of the oil solution of the substituted succinic acylating agent prepared in Example A-7 to 3000 parts of mineral oil and 236 parts of a commercial mixture of ethylene polyamines having an average of about 3-10 nitrogen atoms per molecule at 150° C. over a one-hour period. The reaction mixture is heated at 155°-165° C. for two hours, then stripped by blowing with nitrogen at 165° C. for one hour. The reaction mixture is filtered to yield the filtrate as an oil solution of the desired nitrogen-containing product.

Examples A-14 through A-27 are prepared by following the general procedure set forth in Example A-10.

| Example Number | Reactant(s) | Ratio of Substituted Succinic Acylating Agent To Reactants | Percent Diluent |
|---|---|---|---|
| A-14 | Pentaethlene hexamine[a] | 1:2 equivalents | 40% |
| A-15 | Tris(2-aminoethyl) amine | 2:1 moles | 50% |
| A-16 | Imino-bis-propyl-amine | 2:1 moles | 40% |
| A-17 | Hexamethylene diamine | 1:2 moles | 40% |
| A-18 | 1-(2-Aminoethyl)-2-methyl-2-imidazoline | 1:1 equivalents | 40% |
| A-19 | N-aminopropyl-pyrrolidone | 1:1 moles | 40% |
| A-20 | N,N-dimethyl-1,3-Propane diamine | 1:1 equivalents | 40% |
| A-21 | Ethylene diamine | 1:4 equivalents | 40% |
| A-22 | 1,3-Propane diamine | 1:1 moles | 40% |
| A-23 | 2-Pyrrolidinone | 1:1.1 moles | 20% |
| A-24 | Urea | 1:0.625 moles | 50% |
| A-25 | Diethylenetri-amine[b] | 1:1 moles | 50% |
| A-26 | Triethylene-amine[c] | 1:0.5 moles | 50% |
| A-27 | Ethanolamine | 1:1 moles | 45% |

[a]A commercial mixture of ethylene polyamines corresponding in empirical formula to pentaethylene hexamine.
[b]A commercial mixture of ethylene polyamines corresponding in empirical formula to diethylene triamine.
[c]A commercial mixture of ethylene polyamines corresponding in empirical formula to triethylene tetramine.

EXAMPLE A-28

A mixture is prepared by the addition of 31 parts of carbon disulfide over a period of 1.66 hours to 853 parts of the oil solution of the product prepared in Example A-14 at 113°-145° C. The reaction mixture is held at 145°-152° C. for 3.5 hours, then filtered to yield an oil solution of the desired product.

EXAMPLE A-29

A mixture of 62 parts of boric acid and 2720 parts of the oil solution of the product prepared in Example A-10 is heated at 150° C. under nitrogen for 6 hours. The reaction mixture is filtered to yield the filtrate as an oil solution of the desired boron- containing product.

EXAMPLE A-30

An oleyl ester of boric acid is prepared by heating an equimolar mixture of oleyl alcohol and boric acid in toluene at the reflux temperature while water is removed azeotropically. The reaction mixture is then heated to 150° C. under vacuum and the residue is the ester having a boron content of 3.2% and a saponification number of 62. A mixture of 344 parts of the heater and 2720 parts of the oil solution of the product prepared in Example A-10 is heated at 150° C. for 6 hours and then filtered. The filtrate is an oil solution of the desired boron-containing product.

EXAMPLE A-31

Boron trifuoride (34 parts) is bubbled into 2190 parts of the oil solution of the product prepared in Example A-11 at 80° C. within a period of 3 hours. The resulting mixture is blown with nitrogen at 70°-80° C. for 2 hours to yield the residue as an oil solution of the desired product.

EXAMPLE A-32

A mixture of 3420 parts of the oil-containing solution of the product prepared in Example A-12 and 53 parts of acrylonitrile is heated at reflux temperature from 125°-145° C. for 1.25 hours, at 145° C. for 3 hours and then stripped at 125° C. under vacuum. The residue is an oil solution of the desired product.

EXAMPLE A-33

A mixture is prepared by the addition of 44 parts of ethylene oxide over a period of one hour to 1460 parts of the oil solution of the product prepared in Example A-11 at 150° C. The reaction mixture is held at 150° C. for one hour, then filtered to yield the filtrate as an oil solution of the desired product.

EXAMPLE A-34

A mixture of 1160 parts of the oil solution of the product of Example A-10 and 73 parts of terephthalic acid is heated at 150°-160° C. and filtered. The filtrate is an oil solution of the desired product.

EXAMPLE A-35

A decyl ester of phosphoric acid is prepared by adding one mole of phosphorus pentoxide to three moles of decyl alcohol at a temperature within the range of 32°-55° C. and then heating the mixture at 60°-63° C. until the reaction is complete. The product is a mixture of the decyl esters of phosphoric acid having a phosphorus content of 9.9% and an acid number of 250 (phenolphthalein indicator). A mixture of 1750 parts of the oil solution of the product prepared in Example A-10 and 112 parts of the above decyl ester is heated at 145°-150° C. for one hour. The reaction mixture is filtered to yield the filtrate as an oil solution of the desired product.

EXAMPLE A-36

A mixture of 2920 parts of the oil solution of the product prepared in Example A-11 and 69 parts of thiourea is heated to 80° C. and held at 80° C. for 2 hours. The reaction mixture is then heated at 150°-155° C. for 4 hours, the last of which the mixture is blown with nitro9en. The reaction mixture is filtered to yield the filtrate as an oil solution of the desired product.

EXAMPLE A-37

A mixture of 1460 parts of the oil solution of the product prepared in Example A-11 and 81 parts of a 37% aqueous formaldehyde solution is heated at reflux for 3 hours. The reaction mixture is stripped under vacuum at 150° C. The residue is an oil solution of the desired product.

EXAMPLE A-38

A mixture of 1160 parts of the oil solution of the product prepared in Example A-10 and 67 parts of sulfur monochloride is heated for one hour at 150° C. under nitrogen. The mixture is filtered to yield an oil solution of the desired sulfur-containing product.

EXAMPLE A-39

A mixture is prepared by the addition of 11.5 parts of formic acid to 1000 parts of the oil solution of the product prepared in Example A-11 at 60° C. The reaction mixture is heated at 60°-100° C. for 2 hours, 92°-100° C. for 1.75 hours and then filtered to yield an oil solution of the desired product.

EXAMPLE A-40

An appropriate size flask fitted with a stirrer, nitrogen inlet tube, addition funnel and Dean- Stark trap/-condenser is charged with a mixture of 2483 parts acylating agent (4.2 equivalents) as described in Example A-3, and 1104 parts oil. This mixture is heated to 210° C. while nitrogen was slowly bubbled through it. Ethylene polyamine bottoms (134 parts, 3.14 equivalents) is slowly added over about one hour at this temperature. The temperature is maintained at about 210° C. for 3 hours and then 3688 parts oil is added to decrease the temperature to 125° C. After storage at 138° C. for 17.5 hours, the mixture is filtered through diatomaceous earth to provide a 65% oil solution of the desired acylated amine bottoms.

Component (B) of the diesel lubricants of this invention is at least one basic alkali or alkaline earth metal salt of at least one acidic organic compound. This component is among those art-recognized metal-containing compositions variously referred to by such names as "basic", "superbased" and "overbased" salts or complexes. The method for their preparation is commonly referred to as "overbasing". The term "metal ratio" is often used to define the quantity of metal in these salts or complexes relative to the quantity of organic anion, and is defined as the ratio of the number of equivalents thereof which would be present in a normal salt based upon the usual stoichiometry of the compounds involved.

The basic alkali or alkaline earth metal salt (B) contained in the diesel lubricants of the invention include lithium, sodium, potassium, magnesium, calcium, and barium. Although the presence of a basic detergent is important in controlling viscosity increase in diesel oils, the effectiveness of the detergent depends not only on the amount present but also on the particular metal salt contained in the detergent. Thus, the same equivalents (expressed as TBN or total base number) of a calcium detergent will not give the same level of performance as a sodium detergent. The salts which work best are sodium, potassium and barium. However, barium salts are not the most desirable choices because of potential toxicity. Sodium and potassium are potentially troublesome because in diesel fleet operations, the oil is often analyzed, and traces of sodium or potassium in the oil are often interpreted as signs of a coolant leak into the oil. Accordingly, the preferred salt is calcium Although calcium salts provide a good level of performance in the present invention, it does not perform as well as the sodium, potassium or barium salts would perform. Magnesium detergents are less effective.

The most useful acidic organic compounds are sulfur acids, carboxylic acids, organic phosphorus acids and phenols.

The sulfur acids include sulfonic, sulfamic, thiosulfonic, sulfinic, sulfenic, partial ester sulfuric, sulfurous and thiosulfuric acids. Generally the sulfur acid is a sulfonic acid.

The sulfonic acids are preferred as the acid part of component (B) in the diesel lubricants of the invention. They include those represented by the formulae $R^1(SO_3H)_r$ and $(R^2)_xT(SO_3H)_y$. In these formulae, $R^1$ is an aliphatic or aliphatic-substituted cycloaliphatic hydrocarbon or essentially hydrocarbon radical free from acetylenic unsaturation and containing up to about 60 carbon atoms. When $R^1$ is aliphatic, it usually contains at least about 15 carbon atoms; when it is an aliphatic-substituted cycloaliphatic radical, the aliphatic substituents usually contain a total of at least about 12 carbon atoms. Examples of $R^1$ are alkyl, alkenyl and alkoxyalkyl radicals, and aliphatic-substituted cycloaliphatic radicals wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ are cetylcyclohexyl, laurylcyclohexyl, cetyloxyethyl, octadecenyl, and radicals derived from petroleum, saturated and unsaturated paraffin wax, and olefin polymers including polymerized monoolefins and diolefins containing about 2-8 carbon atoms per olefinic monomer unit. $R^1$ can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

$R^2$ is generally a hydrocarbon or essentially hydrocarbon radical free from acetylenic unsaturation and containing from about 4 to about 60 aliphatic carbon atoms, preferably an aliphatic hydrocarbon radical such as alkyl or alkenyl. It may also, however, contain substituents or interrupting groups such as those enumerated above provided the essentially hydrocarbon character thereof is retained. In general, any non-carbon atoms present in $R^1$ or $R^2$ do not account for more than 10% of the total weight thereof.

T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1-3. The subscripts r and y have an average value of about 1-4 per molecule and are generally also 1.

The following are specific examples of sulfonic acids useful in preparing the salts (B). It is to be understood that such examples serve also to illustrate the salts of such sulfonic acids useful as component (B). In other words, for every sulfonic acid enumerating, it is intended that the corresponding basic alkali metal salts thereof are also understood to be illustrated. (The same applies to the lists of other acid materials listed below, i.e., the carboxylic acids, phosphorus acids and phenols.) Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxy- capryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, paradodecylbenzenesulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic sulfonate salts and techniques for making them can be found in the following U.S. Pat. Nos.: 2,174,110; 2,202,781; 2,239,974; 2,319,121; 2,337,552; 3,488,284; 3,595,790; and 3,798,012. These are hereby incorporated by reference for their disclosures in this regard.

Suitable carboxylic acids include aliphatic, cycloaliphatic and aromatic mono- and polybasic carboxylic acids free from acetylenic unsaturation, including naphthenic acids, alkyl- or alkenyl- substituted cyclopentanoic acids, alkyl- or alkenyl- substituted cyclohexanoic acids, and alkyl- or alkenyl-substituted aromatic carboxylic acids. The aliphatic acids generally contain from about 8 to about 50, and preferably from about 12 to about 25 carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyloctahydroindenecarboxylic acid, palmitic acid, alkyl- and alkenylsuccinic acids, acids formed by oxidation of petrolatum or of hydrocarbon waxes, and commercially available mixtures of two or more carboxylic acids such as tall oil acids, rosin acids, and the like.

The pentavalent phosphorus acids useful in the preparation of component (B) may be represented by the formula

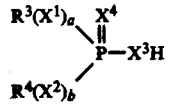

wherein each of $R^3$ and $R^4$ is hydrogen or a hydrocarbon or essentially hydrocarbon group preferably having from about to about 25 carbon atoms, at least one of $R^3$ and $R^4$ being hydrocarbon or essentially hydrocarbon; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

The phosphorus acids may be those of the formula

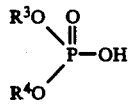

wherein $R^3$ is a phenyl group or (preferably) an alkyl group having up to 18 carbon atoms, and $R^4$ is hydrogen or a similar phenyl or alkyl group. Mixtures of such phosphorus acids are often preferred because of their ease of preparation.

Component (B) may also be prepared from phenols; that is, compounds containing a hydroxy group bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alkyl substituent containing about 3–100 and especially about 6–50 carbon atoms, such as heptylphenol, octylphenol, dodecyl- phenol, tetrapropene-alkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, Methyl Formcel and paraldehyde. Formaldehyde and the formaldehyde-yielding reagents are especially preferred.

The equivalent weight of the acidic organic compound is its molecular weight divided by the number of acidic groups (i.e., sulfonic acid, carboxy or acidic hydroxy groups) present per molecule.

In one preferred embodiment, the alkali metal salts (B) are basic alkali metal salts having metal ratios of at least about 2 and more generally from about 4 to about 40, preferably from about 6 to about 30 and especially from about 8 to about 25.

In another and preferred embodiment, the basic salts (B) are oil-soluble dispersions prepared by contacting for a period of time sufficient to form a stable dispersion, at a temperature between the solidification temperature of the reaction mixture and its decomposition temperature:

(B-1) at least one acidic gaseous material selected from the group consisting of carbon dioxide, hydrogen sulfide and sulfur dioxide, with (B-2) a reaction mixture comprising (B-2-a) at least one oil-soluble sulfonic acid, or derivative thereof susceptible to overbasing;

(B-2-b) at least one alkali or alkaline earth metal or basic alkali metal compound;

(B-2-c) at least one lower aliphatic alcohol, alkyl phenol, or sulfurized alkyl phenol; and (B-2-d) at least one oil-soluble carboxylic acid or functional derivative thereof. When (B-2-c) is an alkyl phenol or a sulfurized alkyl phenol, component (B-2-d) is optional. A satisfactory basic sulfonic acid salt can be prepared with or without the carboxylic acid in the mixture (B-2).

Reagent (B-1) is at least one acidic gaseous material which may be carbon dioxide, hydrogen sulfide or sulfur dioxide; mixtures of these gases are also useful. Carbon dioxide is preferred.

As mentioned above, reagent (B-2) generally is a mixture containing at least four components of which component (B-2-a) is at least one oil-soluble sulfonic acid as previously defined, or a derivative thereof susceptible to overbasing. Mixtures of sulfonic acids and/or their derivatives may also be used. Sulfonic acid derivatives susceptible to overbasing include their metal salts, especially the alkaline earth, zinc and lead salts; ammonium salts and amine salts (e.g., the ethylamine, butylamine and ethylene polyamine salts); and esters such as the ethyl, butyl and glycerol esters.

Component (B-2-b) is at least one alkali or alkaline earth metal or a basic compound thereof. Illustrative of basic alkali or alkaline earth metal compounds are the hydroxides, alkoxides (typically those in which the alkoxy group contains up to 10 and preferably up to 7 carbon atoms), hydrides and amides. Thus, useful basic alkali or alkaline earth metal compounds include sodium hydroxide, potassium hydroxide, lithium hydroxide, magnesium oxide, calcium oxide, magnesium oxide, calcium hydroxide, magnesium hydroxide, barium oxide, barium hydroxide, sodium propoxide, lithium methoxide, potassium ethoxide, sodium butoxide, magnesium ethoxide, calcium ethoxide, barium ethoxide, lithium hydride, sodium hydride, potassium hydride, calcium hydride, lithium amide, sodium amide calcium amide, and potassium amide. Especially preferred are sodium hydroxide and the sodium lower alkoxides (i.e., those containing up to 7 carbon atoms). The alkaline earth oxides and hydroxides are the preferred alkaline earth compounds. The equivalent weight of component (B-2-b) for the purpose of this invention is equal to its molecular weight, for the monovalent alkali metals and one half the molecular weight for the divalent alkaline earth metals.

Component (B-2-c) may be at least one lower aliphatic alcohol, preferably a monohydric or dihydric alcohol. Illustrative alcohols are methanol, ethanol, 1-propanol, 1-hexanol, isopropanol, isobutanol, 2-pentanol, 2,2-dimethyl-1-propanol, ethylene glycol, 1-3-propanediol and 1,5-pentanediol. The alcohol also may be a glycol ether such as Methyl Cellosolve. Of these, the preferred alcohols are methanol, ethanol and propanol, with methanol being especially preferred.

Component (B-2-c) also may be at least one alkyl phenol or sulfurized alkyl phenol. The sulfurized alkyl phenols are preferred, especially when (B-2-b) is potassium or one of its basic compounds such as potassium hydroxide. As used herein, the term "phenol" includes compounds having more than one hydroxy group bound to an aromatic ring, and the aromatic ring may be a benzyl or naphthyl ring. The term "alkyl phenol" includes mono- and di-alkylated phenols in which each alkyl substituent contains from about 6 to about 100 carbon atoms, preferably about 6 to about 50 carbon atoms.

Illustrative alkyl phenols include heptylphenols, octylphenols, decylphenols, dodecylphenols, polypropylene (M.W. of about 150)-substituted phenols, polyisobutene (M.W. of about 1200)-substituted phenols, cyclohexyl phenols.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, Methyl Formcel and paraldehyde. Formaldehyde and the formaldehyde-yielding reagents are especially preferred.

The sulfurized alkylphenols include phenol sulfides, disulfides or polysulfides. The sulfurized phenols can be derived from any suitable alkylphenol by technique known to those skilled in the art, and many sulfurized phenols are commercially available. The sulfurized alkylphenols may be prepared by reacting an alkylphenol with elemental sulfur and/or a sulfur monohalide (e.g., sulfur monochloride). This reaction may be conducted in the presence of excess base to result in the salts of the mixture of sulfides, disulfides or polysulfides that may be produced depending upon the reaction conditions. It is the resulting product of this reaction which is used in the preparation of component (B-2) in the present invention. U.S. Pat. Nos. 2,971,940 and 4,309,293 disclose various sulfurized phenols which are illustrative of component (B-2-c).

The following non-limiting examples illustrate the preparation of alkylphenols and sulfurized alkylphenols useful as component (B-2-c).

EXAMPLE 1

While maintaining a temperature of 55° C., 100 parts phenol and 68 parts sulfonated polystyrene catalyst (marketed as Amberlyst-15 by Rohm and Haas Company) are charged to a reactor equipped with a stirrer, condenser, thermometer and subsurface gas inlet tube. The reactor contents are then heated to 120° while nitrogen blowing for 2 hours. Propylene tetramer (1232 parts) is charged, and the reaction mixture is stirred at 120° C. for 4 hours. Agitation is stopped, and the batch is allowed to settle for 0.5 hour. The crude supernatant reaction mixture is filtered and vacuum stripped until a maximum of 0.5% residual propylene tetramer remains.

EXAMPLE 2

Benzene (217 parts) is added to phenol (324 parts, 3.45 moles) at 38° C. and the mixture is heated to 47° C. Boron trifluoride (8.8 parts, 0.13 mole) is blown into the mixture over a one-half hour period at 38°-52° C. Polyisobutene (1000 parts, 1.0 mole) derived from the polymerization of $C_4$ monomers predominating in isobutylene is added to the mixture at 52°-58° C. over a 3.5 hour period. The mixture is held at 52° C. for 1 additional hour. A 26% solution of aqueous ammonia (15 parts) is added and the mixture is heated to 70° C. over a 2-hour period. The mixture is then filtered and the filtrate is the desired crude polyisobutene-substituted phenol. This intermediate is stripped by heating 1465 parts to 167° C. and the pressure is reduced to 10 mm. as the material is heated to 218° C. in a 6-hour period. A 64% yield of stripped polyisobutene-substituted phenol (Mn=885) is obtained as the residue.

EXAMPLE 3

A reactor equipped with a stirrer, condenser, thermometer and subsurface addition tube is charged with 1000 parts of the reaction product of Example 1. The temperature is adjusted to 48°-49° and 319 parts sulfur dichloride is added while the temperature is kept below 60°. The batch is then heated to 88°-93° while nitrogen blowing until the acid number (using bromphenol blue indicator) is less than 4.0. 400 parts diluent oil is then added, and the mixture is mixed thoroughly.

EXAMPLE 4

Following the procedure of Example 3, 1000 parts of the reaction product of Example 1 is reacted with 175 parts of sulfur dichloride. The reaction product is diluted with 400 parts diluent oil.

EXAMPLE 5

Following the procedure of Example 3, 1000 parts of the reaction product of Example 1 is reacted with 319 parts of sulfur dichloride. Diluent oil (788 parts) is added to the reaction product, and the materials are mixed thoroughly.

EXAMPLE 6

Following the procedure of Example 4, 1000 parts of the reaction product of Example 2 are reacted with 44 parts of sulfur dichloride to produce the sulfurized phenol.

EXAMPLE 7

Following the procedure of Example 5, 1000 parts of the reaction product of Example 2 are reacted with 80 parts of sulfur dichloride.

The equivalent weight of component (B-2-c) is its molecular weight divided by the number of hydroxy groups per molecule.

Component (B-2-d) is at least one oil-soluble carboxylic acid as previously described, or functional derivative thereof. Especially suitable carboxylic acids are those of the formula $R^5(COOH)_n$, wherein n is an integer from 1 to 6 and is preferably 1 or 2 and $R^5$ is a saturated or substantially saturated aliphatic radical (preferably a hydrocarbon radical) having at least 8 aliphatic carbon atoms. Depending upon the value of n, $R^5$ will be a monovalent to hexavalent radical.

$R^5$ may contain non-hydrocarbon substituents provided they do not alter substantially its hydrocarbon character. Such substituents are preferably present in amounts of not more than about 20% by weight. Exemplary substituents include the non- hydrocarbon substituents enumerated hereinabove with reference to component (B-2-a). $R^5$ may also contain olefinic unsaturation up to a maximum of about 5% and preferably not more than 2% olefinic linkages based upon the total number of carbon-to-carbon covalent linkages present. The number of carbon atoms in $R^5$ is usually about 8-700 depending upon the source of $R^5$. As discussed below, a preferred series of carboxylic acids and derivatives is prepared by reacting an olefin polymer or halogenated olefin polymer with an alpha,beta-unsaturated acid or its anhydride such as acrylic, methacrylic, maleic or fumaric acid or maleic anhydride to form the corresponding substituted acid or derivative thereof. The $R^5$ groups in these products have a number average molecular weight from about 150 to about 10,000 and usually from about 700 to about 5000, as determined, for example, by gel permeation chromatography.

The monocarboxylic acids useful as component (B-2-d) have the formula $R^5COOH$. Examples of such acids are caprylic, capric, palmitic, stearic, isostearic, linoleic and behenic acids. A particularly preferred group of monocarboxylic acids is prepared by the reaction of a halogenated olefin polymer, such as a chlorinated polybutene, with acrylic acid or methacrylic acid.

Suitable dicarboxylic acids include the substituted succinic acids having the formula

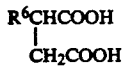

wherein $R^6$ is the same as $R^5$ as defined above. $R^6$ may be an olefin polymer-derived group formed by polymerization of such monomers as ethylene, propylene, 1-butene, isobutene, 1-pentene, 2-pentene, 1-hexene and 3-hexene. $R^6$ may also be derived from a high molecular weight substantially saturated petroleum fraction. The hydrocarbon-substituted succinic acids and their derivatives constitute the most preferred class of carboxylic acids for use as component (B-2-d).

The above-described classes of carboxylic acids derived from olefin polymers, and their derivatives, are well known in the art, and methods for their preparation as well as representative examples of the types useful in the present invention are described in detail in a number of U.S. Patents.

Functional derivatives of the above-discussed acids useful as component (B-2-d) include the anhydrides, esters, amides, imides, amidines and metal or ammonium salts. The reaction products of olefin polymer-substituted succinic acids and mono- or polyamines, particularly polyalkylene polyamines, having up to about 10 amino nitrogens are especially suitable. These reaction products generally comprise mixtures of one or more of amides, imides and amidines. The reaction products of polyethylene amines containing up to about 10 nitrogen atoms and polybutene-substituted succinic anhydride wherein the polybutene radical comprises principally isobutene units are particularly useful. Included in this group of functional derivatives are the compositions prepared by post-treating the amine-anhydride reaction product with carbon disulfide, boron compounds, nitriles, urea, thiourea, guanidine, alkylene oxides or the like. The half-amide, half-metal salt and half-ester, half-metal salt derivatives of such substituted succinic acids are also useful.

Also useful are the esters prepared by the reaction of the substituted acids or anhydrides with a mono- or polyhydroxy compound, such as an aliphatic alcohol or a phenol. Preferred are the esters of olefin polymer-substituted succinic acids or anhydrides and polyhydric aliphatic alcohols containing 2–10 hydroxy groups and up to about 40 aliphatic carbon atoms. This class of alcohols includes ethylene glycol, glycerol, sorbitol, pentaerythritol, poly- ethylene glycol, diethanolamine, triethanolamine,N,N'-di(hydroxyethyl)ethylene diamine and the like. When the alcohol contains reactive amino groups, the reaction product may comprise products resulting from the reaction of the acid group with both the hydroxy and amino functions. Thus, this reaction mixture can include half-esters, half-amides, esters, amides, and imides.

The ratios of equivalents of the constituents of reagent (B-2) may vary widely. In general, the ratio of component (B-2-b) to (B-2-a) is at least about 4:1 and usually not more than about 40:1, preferably between 6:1 and 30:1 and most preferably between 8:1 and 25:1. While this ratio may sometimes exceed 40:1, such an excess normally will serve no useful purpose.

The ratio of equivalents of component (B-2-c) to component (B-2-a) is between about 1:20 and 80:1, and preferably between about 2:1 and 50:1. As mentioned above, when component (B-2-c) is an alkyl phenol or sulfurized alkyl phenol, the inclusion of the carboxylic acid (B-2-d) is optional. When present in the mixture, the ratio of equivalents of component (B-2-d) to component (B-2-a) generally is from about 1:1 to about 1:20 and preferably from about 1:2 to about 1:10.

Reagents (B-1) and (B-2) are generally contacted until there is no further reaction between the two or until the reaction substantially ceases. While it is usually preferred that the reaction be continued until no further overbased product is formed, useful dispersions can be prepared when contact between reagents (B-1) and (B-2) is maintained for a period of time sufficient for about 70% of reagent (B-1), relative to the amount required if the reaction were permitted to proceed to its completion or "end point", to react.

The point at which the reaction is completed or substantially ceases may be ascertained by any of a number of conventional methods. One such method is measurement of the amount of gas (reagent (B-1)) entering and leaving the mixture; the reaction may be considered substantially complete when the amount leaving is about 90–100% of the amount entering. These amounts are readily determined by the use of metered inlet and outlet valves.

When (B-2-c) is an alcohol, the reaction temperature is not critical. Generally, it will be between the solidification temperature of the reaction mixture and its decomposition temperature (i.e., the lowest decomposition temperature of any component thereof). Usually, the temperature will be from about 25° to about 200° C. and preferably from about 50° to about 150° C. Reagents (B-1) and (B-2) are conveniently contacted at the reflux temperature of the mixture. This temperature will obviously depend upon the boiling points of the various components; thus, when methanol is used as component (B-2-c), the contact temperature will be at or below the reflux temperature of methanol.

When reagent (B-2-c) is an alkyl phenol or a sulfurized alkyl phenol, the temperature of the reaction must be at or above the water-diluent azeotrope temperature so that the water formed in the reaction can be removed. Thus the diluent in such cases generally will be a volatile organic liquid such as aliphatic and aromatic hydrocarbons. Examples of such diluents include heptane, decane, toluene, xylene, etc.

The reaction is ordinarily conducted at atmospheric pressure, although superatmospheric pressure often expedites the reaction and promotes optimum utilization of reagent (B-1). The process can also be carried out at reduced pressure but, for obvious practical reasons, this is rarely done.

The reaction is usually conducted in the presence of a substantially inert, normally liquid organic diluent, which functions as both the dispersing and reaction medium. This diluent will comprise at least about 10% of the total weight of the reaction mixture. Ordinarily it will not exceed about 80% by weight, and it is preferably about 30–70% thereof.

Although a wide variety of diluents are useful, it is preferred to use a diluent which is soluble in lubricating oil. The diluent usually itself comprises a low viscosity lubricating oil.

Other organic diluents can be employed either alone or in combination with lubricating oil. Preferred diluents for this purpose include the aromatic hydrocarbons such as benzene, toluene and xylene; halogenated derivatives thereof such as chlorobenzene; lower boiling petroleum distillates such as petroleum ether and various naphthas; normally liquid aliphatic and cycloaliphatic hydrocarbons such as hexane, heptane, hexene, cyclohexene, cyclopentane, cyclohexane and ethylcyclohexane, and their halogenated derivatives. Dialkyl ketones such as dipropyl ketone and ethyl butyl ketone, and the alkyl aryl ketones such as acetophenone, are likewise useful, as are ethers such as n-propyl ether, n-butyl ether, n-butyl methyl ether and isoamyl ether.

When a combination of oil and other diluent is used, the weight ratio of oil to the other diluent is generally from about 1:20 to about 20:1. It is usually desirable for a mineral lubricating oil to comprise at least about 50% by weight of the diluent, especially if the product is to be used as a lubricant additive. The total amount of diluent present is not particularly critical since it is inactive. However, the diluent will ordinarily comprise about 10–80% and preferably about 30–70% by weight of the reaction mixture.

Upon completion of the reaction, any solids in the mixture are preferably removed by filtration or other conventional means. Optionally, readily removable diluents, the alcoholic promoters, and water formed during the reaction can be removed by conventional techniques such as distillation. It is usually desirable to remove substantially all water from the reaction mixture since the presence of water may lead to difficulties in filtration and to the formation of undesirable emulsions in fuels and lubricants. Any such water present is readily removed by heating at atmospheric or reduced pressure or by azeotropic distillation. In one preferred embodiment, when basic potassium sulfonates are desired as component (B), the potassium salt is prepared using carbon dioxide and the sulfurized alkylphenols as component (B-2-c). The use of the sulfurized phenols results in basic salts of higher metal ratios and the formation of more uniform and stable salts. Also, the reaction generally is conducted in an aromatic diluent such as xylene, and water is removed as a xylene-water azeotrope during the reaction.

The chemical structure of component (B) is not known with certainty. The basic salts or complexes may be solutions or, more likely, stable dispersions. Alternatively, they may be regarded as "polymeric salts" formed by the reaction of the acidic material, the oil-soluble acid being overbased, and the metal compound. In view of the above, these compositions are most conveniently defined by reference to the method by which they are formed.

The above-described procedure for preparing alkali metal salts of sulfonic acids having a metal ratio of at least about 2 and preferably a metal ratio between about 4 to 40 using alcohols as component (B-2-c) is described in more detail in Canadian Patent 1,055,700 which corresponds to British Patent 1,481,553. These patents are incorporated by reference for their disclosures of such processes. The term conversion relates to the ratio of equivalents of metal to equivalents of organic acid which are incorporated into the material. Low conversion often refers to materials with ratios of 1:1 to 5:1 while high conversion implies ratios of 5:1 to 20:1. The preparation of oil-soluble dispersions of alkali metal sulfonates useful as component (B) in the diesel lubricants of this invention is illustrated in the following examples.

EXAMPLE B-1

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 parts (20 equivalents) of methanol. The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155°–165° C. for about 30 minutes and filtered to yield an oil solution of the desired basic sodium sulfonate having a metal ratio of about 7.75. This solution contains 12.5% oil.

EXAMPLE B-2

Following the procedure of Example B-1, a solution of 780 parts (1 equivalent) of an alkylated benzenesulfonic acid and 119 parts of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh. for 11 minutes as the temperature slowly increases to 97° C. The rate of carbon dioxide flow is reduced to 6 cfh. and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75. This solution contains 18.7% oil.

EXAMPLE B-3

Following the procedure of Example B-1, a solution of 3120 parts (4 equivalents) of an alkylated benzenesulfonic acid and 284 parts of the polybutenyl succinic anhydride in 704 parts of mineral oil is mixed with 1280 parts (32 equivalents) of sodium hydroxide and 2560 parts (80 equivalents) of methanol. The mixture is blown with carbon dioxide at 10 cfh. for 65 minutes as the temperature increases to 90° C. and then slowly decreases to 70° C. The volatile material is stripped by blowing nitrogen at 2 cfh. for 2 hours as the temperature is slowly increased to 160° C. After stripping is completed, the mixture is held at 160° C. for 0.5 hour, and then filtered to yield an oil solution of the desired basic sodium sulfonate having a metal ratio of about 7.75. This solution contains 12.35% oil content.

EXAMPLE B-4

Following the procedure of Example B-1, a solution of 3200 parts (4 equivalents) of an alkylated benzenesulfonic acid and 284 parts of the polybutenyl succinic anhydride in 623 parts of mineral oil is mixed with 1280 parts (32 equivalents) of sodium hydroxide and 2560 parts (80 equivalents) of methanol. The mixture is blown with carbon dioxide at 10 cfh. for about 77 minutes. During this time the temperature increases to 92° C. and then gradually drops to 73° C. The volatile materials are stripped by blowing with nitrogen gas at 2 cfh. for about 2 hours as the temperature of the reaction mixture is slowly increased to 160° C. The final traces of volatile material are vacuum stripped and the residue is held at 170° C. and then filtered to yield a clear oil solution of the desired sodium salt, having a metal ratio of about 7.72. This solution has an oil content of 11%.

EXAMPLE B-5

Following the procedure of Example B-1, a solution of 780 parts (1 equivalent) of an alkylated benzenesulfonic acid and 86 parts of the polybutenyl succinic anhydride in 254 parts of mineral oil is mixed with 480 parts (12 equivalents) of sodium hydroxide and 640 parts (20 equivalents) of methanol. The reaction mixture is blown with carbon dioxide at 6 cfh. for about 45 minutes. During this time the temperature increases to 95° C. and then gradually decreases to 74° C. The volatile material is stripped by blowing with nitrogen gas at 2 cfh. for about one hour as the temperature is increased to 160° C. After stripping is complete the mixture is held at 160° C. for 0.5 hour and then filtered to yield an oil solution of the desired sodium salt, having a metal ratio of 11.8. The oil content of this solution is 14.7%.

EXAMPLE B-6

Following the procedure of Example B-1, a solution of 3120 parts (4 equivalents) of an alkylated benzenesulfonic acid and 344 parts of the polybutenyl succinic anhydride in 1016 parts of mineral oil is mixed with 1920 parts (48 equivalents) of sodium hydroxide and 2560 parts (80 equivalents) of methanol. The mixture is blown with carbon dioxide at 10 cfh. for about 2 hours. During this time the temperature increases to 96° C. and then gradually drops to 74° C. The volatile materials are stripped by blowing with nitrogen gas at 2 cfh. for about 2 hours as the temperature is increased from 74° to 160° C. by external heating. The stripped mixture is heated for an additional hour at 160° C. and filtered. The filtrate is vacuum stripped to remove a small amount of water, and again filtered to give a solution of the desired sodium salt, having a metal ratio of about 11.8. The oil content of this solution is 14.7%.

EXAMPLE B-7

Following the procedure of Example B-1, a solution of 2800 parts (3.5 equivalents) of an alkylated benzenesulfonic acid and 302 parts of the polybutenyl succinic anhydride in 818 parts of mineral oil is mixed with 1680 parts (42 equivalents) of sodium hydroxide and 2240 parts (70 equivalents) of methanol. The mixture is blown with carbon dioxide for about 90 minutes at 10 cfh. During this period, the temperature increases to 96° C. and then slowly drops to 76° C. The volatile materials are stripped by blowing with nitrogen at 2 cfh. as the temperature is slowly increased from 76° C. to 165° C. by external heating. Water is removed by vacuum stripping. Upon filtration, an oil solution of the desired basic sodium salt is obtained. It has a metal ratio of about 10.8 and the oil content is 13.6%.

EXAMPLE B-8

Following the procedure of Example B-1, a solution of 780 parts (1 equivalent) of an alkylated benzenesulfonic acid and 103 parts of the polybutenyl succinic anhydride in 350 parts of mineral oil is mixed with 640 parts (16 equivalents) of sodium hydroxide and 640 parts (20 equivalents) of methanol. This mixture is blown with carbon dioxide for about one hour at 6 cfh. During this period, the temperature increases to 95° C. and then gradually decreases to 75° C. The volatile material is stripped by blowing with nitrogen. During stripping, the temperature initially drops to 70° C. over 30 minutes and then slowly rises to 78° C. over 15 minutes. The mixture is then heated to 155° C. over 80 minutes. The stripped mixture is heated for an additional 30 minutes at 155°-160° C. and filtered. The filtrate is an oil solution of the desired basic sodium sulfonate, having a metal ratio of about 15.2. It has an oil content of 17.1%.

EXAMPLE B-9

Following the procedure of Example B-1, a solution of 2400 parts (3 equivalents) of an alkylated benzenesulfonic acid and 308 parts of the polybutenyl succinic anhydride in 991 parts of mineral oil is mixed with 1920 parts (48 equivalents) of sodium hydroxide and 1920 parts (60 equivalents) of methanol. This mixture is blown with carbon dioxide at 10 cfh. for 110 minutes, during which time the temperature rises to 98° C. and then slowly decreases to 76° C. over about 95 minutes. The methanol and water are stripped by blowing with nitrogen at 2 cfh. as the temperature of the mixture slowly increases to 165° C. The last traces of volatile material are vacuum stripped and the residue is filtered to yield an oil solution of the desired sodium salt having a metal ratio of 15.1. The solution has an oil content of 16.1%.

EXAMPLE B-10

Following the procedure of Example B-1, a solution of 780 parts (1 equivalent) of an alkylated benzenesulfonic acid and 119 parts of the polybutenyl succinic anhydride in 442 parts of mineral oil is mixed well with 800 parts (20 equivalents) of sodium hydroxide and 640 parts (20 equivalents) of methanol. This mixture is blown with carbon dioxide for about 55 minutes at 8 cfh. During this period, the temperature of the mixture increases to 95° C. and then slowly decreases to 67° C. The methanol and water are stripped by blowing with nitrogen at 2 cfh. for about 40 minutes while the temperature is slowly increased to 160° C. After stripping, the temperature of the mixture is maintained at 160°-165° C. for about 30 minutes. The product is then filtered to give a solution of the corresponding sodium sulfonate having a metal ratio of about 16.8. This solution contains 18.7% oil.

EXAMPLE B-11

Following the procedure of Example B-1, 836 parts (1 equivalent) of a sodium petroleum sulfonate (sodium "Petronate") in an oil solution containing 48% oil and 63 parts of the polybutenyl succinic anhydride is heated to 60° C. and treated with 280 parts (7 equivalents) of sodium hydroxide and 320 parts (10 equivalents) of methanol. The reaction mixture is blown with carbon dioxide at 4 cfh. for about 45 minutes. During this time, the temperature increases to 85° C. and then slowly decreases to 74° C. The volatile material is stripped by blowing with nitrogen at 2 cfh. while the temperature is gradually increased to 160° C. After stripping is completed, the mixture is heated an additional 30 minutes at 160° C. and then is filtered to yield the sodium salt in solution. The product has a metal ratio of 8.0 and an oil content of 22.2%.

EXAMPLE B-12

Following the procedure of Example B-11, 1256 parts (1.5 equivalents) of the sodium petroleum sulfonate in an oil solution containing 48% oil and 95 parts of polybutenyl succinic anhydride is heated to 60° C. and treated with 420 parts (10.5 equivalents) of sodium hydroxide and 60 parts (30 equivalents) of methanol. The mixture is blown with carbon dioxide at 4 cfh. for 60 minutes. During this time, the temperature is increased to 90° C. and then slowly decreases to 70° C. The volatile materials are stripped by blowing with nitrogen and slowly increasing the temperature to 160° C. After stripping, the reaction mixture is allowed to stand at 160° C. for 30 minutes and then is filtered to yield an oil solution of sodium sulfonate having a metal ratio of about 8.0. The oil content of the solution is 22.2%.

EXAMPLE B-13

A mixture of 584 parts (0.75 mole) of a commercial dialkyl aromatic sulfonic acid, 144 parts (0.37 mole) of a sulfurized tetrapropenyl phenol prepared as in Example 3, 93 parts of a polybutenyl succinic anhydride as used in Example B-1, 500 parts of xylene and 549 parts of oil is prepared and heated with stirring to 70° C. whereupon 97 parts of potassium hydroxide are added. The mixture is heated to 145° C. while azeotroping water and xylene. Additional potassium hydroxide (368 parts) is added over 10 minutes and heating is continued at about 145°-150° C. whereupon the mixture is blown with carbon dioxide at 1.5 cfh. for about 110 minutes. The volatile materials are stripped by blowing with nitrogen and slowly increasing the temperature to about 160° C. After stripping, the reaction mixture is filtered to yield an oil solution of the desired potassium sulfonate having a metal ratio of about 10. Additional oil is added to the reaction product to provide an oil content of the final solution of 39%.

EXAMPLE B-14

A mixture of 705 parts (0.75 mole) of a commercially available mixture of straight and branched chain alkyl aromatic sulfonic acid, 98 parts (0.37 mole) of a tetrapropenyl phenol prepared as in Example 1, 97 parts of a polybutenyl succinic anhydride as used in Example B-1, 750 parts of xylene, and 133 parts of oil is prepared and heated with stirring to about 50° C. whereupon 65 parts of sodium hydroxide dissolved in 100 parts of water are added. The mixture is heated to about 145° C. while removing an azeotrope of water and xylene. After cooling the reaction mixture overnight, 279 parts of sodium hydroxide are added. The mixture is heated to 145° C. and blown with carbon dioxide at about 2 cfh. for 1.5 hours. An azeotrope of water and xylene is removed. A second increment of 179 parts of sodium hydroxide is added as the mixture is stirred and heated to 145° C. whereupon the mixture is blown with carbon dioxide at a rate of 2 cfh. for about 2 hours. Additional oil (133 parts) is added to the mixture after 20 minutes. A xylene:water azeotrope is removed and the residue is stripped to 170° C. at 50 mm. Hg. The reaction mixture is filtered through a filter aid and the filtrate is the desired product containing 17.01% sodium and 1.27% sulfur.

EXAMPLE B-15

A mixture of 386 parts (0.75 mole) of a commercially available primary branched chain monoalkyl aromatic sulfonic acid, 58 parts (0.15 mole) of a sulfurized tetrapropenyl phenol prepared as in Example 3, 926 grams of oil and 700 grams of xylene is prepared, heated to a temperature of 70° C. whereupon 97 parts of potassium hydroxide are added over a period of 15 minutes. The mixture is heated to 145° C. while removing water. An additional 368 parts of potassium hydroxide are added over 10 minutes, and the stirred mixture is heated to 145° C. whereupon the mixture is blown with carbon dioxide at 1.5 cfh. for about 2 hours. The mixture is stripped to 150° C. and finally at 150° C. at 50 mm. Hg. The residue is filtered, and the filtrate is the desired product.

The diesel lubricants of the present invention containing components (A) and (B) as described above may be further characterized as containing at least about 0.8 sulfate ash and more generally at least about 1% sulfate ash. The amounts of components (A) and (B) included in the diesel lubricants of the present invention may vary over a wide range as can be determined by one skilled in the art. Generally, however, the diesel lubricants of the present invention will contain from about 1.0 to about 10% by weight of component (A) and from about 0.05 to about 5% and more generally up to about 1% by weight of component (B).

As indicated above, the diesel lubricants of the present invention may also contain as a (B) component at least one oil-soluble basic alkaline earth metal salt of at least one acidic organic compound. Such salt compounds generally are referred to as ash- containing detergents.

The commonly employed methods for preparing the basic salts comprises heating a mineral oil solution of the acid with a stoichiometric excess of a metal neutralizing agent, e.g., a metal oxide, hydroxide, carbonate, bicarbonate, sulfide, etc., at temperatures above about 50° C. In addition, various promoters may be used in the neutralizing process to aid in the incorporation of the large excess of metal. These promoters are presently known and include such compounds as the phenolic substances, e.g., phenol, naphthol, alkylphenol, thiophenol, sulfurized alkyl- phenol and the various condensation products of formaldehyde with a phenolic substance, e.g., alcohols such as methanol, 2-propanol, octyl alcohol, cellosolve carbitol, ethylene, glycol, stearyl alcohol, and cyclohexyl alcohol; amines such as aniline, phenylene- diamine, phenothiazine, phenyl-beta-naphthylamine, and dodecyl amine, etc. A particularly effective process for preparing the basic salts comprises mixing the acid with an excess of the basic alkaline earth metal in the presence of the phenolic promoter and a small amount of water and carbonating the mixture at an elevated temperature, e.g., 60° C. to about 200° C.

The following examples illustrate the preparation of neutral and basic alkaline earth metal salts useful as component (B).

EXAMPLE B-16

A mixture of 906 parts of an oil solution of an alkyl phenyl sulfonic acid (having an average molecular weight of 450, vapor phase osmometry), 564 parts mineral oil, 600 parts toluene, 98.7 parts magnesium oxide and 120 parts water is blown with carbon dioxide at a temperature of 78°-85° C. for 7 hours at a rate of about 3 cubic feet of carbon dioxide per hour. The reaction mixture is constantly agitated throughout the carbonation. After carbonation, the reaction mixture is stripped to 165°/20 tor and the residue filtered. The filtrate is an oil solution of the desired overbased magnesium sulfonate having a metal ratio of about 3.

EXAMPLE B-17

A polyisobutenyl succinic anhydride is prepared by reacting a chlorinated poly(isobutene) (having an average chlorine content of 4.3% and an average of 82 carbon atoms) with maleic anhydride at about 200° C. The resulting polyisobutenyl succinic anhydride has a saponification number of 90. To a mixture of 1246 parts of this succinic anhydride and 1000 parts of toluene there is added at 25° C., 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration provides a filtrate having a barium content of 4.71%.

EXAMPLE B-18

A basic calcium sulfonate having a metal ratio of about 15 is prepared by carbonation, in increments, of a mixture of calcium hydroxide, a neutral sodium petroleum sulfonate, calcium chloride, methanol and an alkyl phenol.

EXAMPLE B-19

A mixture of 323 parts of mineral oil, 4.8 parts of water, 0.74 parts of calcium chloride, 79 parts of lime, and 128 parts of methyl alcohol is prepared, and warmed to a temperature of about 50° C. To this mixture there is added 1000 parts of an alkyl phenyl sulfonic acid having an average molecular weight (vapor phase osmometry) of 500 with mixing. The mixture then is blown with carbon dioxide at a temperature of about 50° C. at the rate of about 5.4 pounds per hour for about 2.5 hours. After carbonation, 102 additional parts of oil are added and the mixture is stripped of volatile materials at a temperature of about 150°-155° C. at 55 mm. pressure. The residue is filtered and the filtrate is the desired oil solution of the overbased calcium sulfonate having calcium content of about 3.7% and a metal ratio of about 1.7.

The present invention also contemplates the use of other additives in the diesel lubricant compositions of the present invention. These other additives include such conventional additive types as anti-oxidants, extreme pressure agents, corrosion- inhibiting agents, pour point depressants, color stabilizing agents, anti-foam agents, and other such additive materials known generally to those skilled in the art of formulating diesel lubricants.

Extreme pressure agents and corrosion- and oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetra- sulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125-162.

The diesel lubricants of the present invention are useful in the operation of diesel engines, and when the diesel lubricants of the present invention are so utilized, the diesel engines can be operated for longer periods of time without undergoing undesirable viscosity increases. Furthermore, the diesel lubricants of the present invention are capable of passing the Caterpillar 1-G2, CLR L-38 and the Mack T-7.

The advantages of the diesel lubricants of the present invention is demonstrated by subjecting the diesel lubricants of lubricant Examples III-V to the Mack Truck Technical Services Standard Test Procedure No. 5GT 57 entitled "Mack T-7: Diesel Engine Oil Viscosity Evaluation", dated Aug. 31, 1984. This test has been designed to correlate with field experience. In this test, a Mack EM6-285 engine is operated under low speed, high torque, steady-state conditions. The engine is a direct injection, in-line, six-cylinder, four-stroke, turbocharged series charge air-cooled compression ignition engine containing keystone rings. The rated power is 283 bhp at 2300 rpm governed speed.

The test operation consists of an initial break-in-period (after major rebuild only) a test oil flush, and 150 hours of steady state operation at 1200 rpm and 1080 ft/lb. of torque. No oil changes or additions are made, although eight 4 oz. oil samples are taken periodically from the oil pan drain valve during the test for analysis. Sixteen ounces of oil are taken at the oil pan drain valve before each 4 oz. sample is taken to purge the drain line. This purge sample is then returned to the engine after sampling. No make-up oil is added to the engine to replace the 4 oz. samples.

The kinematic viscosity at 210° F. is measured at 100 and 150 hours into the test, and the "viscosity slope" is calculated. The "viscosity slope" is defined as the difference between the 100 and 150-hour viscosity divided by 50. It is desirable that the viscosity slope should be as small a number as possible, reflecting a minimum viscosity increase as the test progresses.

The kinematic viscosity at 210° F. can be measured by two procedures. In both procedures, the sample is passed through a No. 200 sieve before it is loaded into the Cannon reverse flow viscometer. In the ASTM D-445 method, the viscometer is chosen to result in flow times equal to or greater than 200 seconds. In the method described in the Mack T-7 specification, a Cannon 300 viscometer is used for all viscosity determinations. Flow times for the latter procedure are typically 50–100 seconds for fully formulated 15W-40 diesel lubricants.

The present invention will be further understood by a consideration of the following examples which are intended to be purely exemplary of the invention. Other embodiments of the invention will be apparent to those skilled in the art from a consideration of the following examples.

EXAMPLE 1

A lubricating oil formulation, with a TBN of 7.2 of which 6.1 TBN is contributed by the metallic detergents, was prepared containing a viscosity modifier, a pour point depressant, an antiwear agent, an antioxidant, an anti-foam agent, 5.2% of the succinimide dispersant of example A-11, 1.8% of a calcium phenate detergent, 0.4% of a high conversion magnesium sulfonate detergent and 0.75% of a lower conversion magnesium sulfonate detergent. This composition had a viscosity increase slope of 0.16 cSt/hr. in the Mack T-7 test. This slope indicates failure of the test.

EXAMPLE 2

A lubricating oil formulation similar to that of example with a TBN of 7.2 of which 6.1 TBN is contributed by the metallic detergents, containing a viscosity modifier, a pour point depressant, an antiwear agent, an antioxidant, an anti-foam agent, 4.2% of the succinimide dispersant of example A-11, 2% of a second dispersant formed by reacting a polyisobutylene derivative of succinic acid with a polyol and a polyamine; 1.8% of a calcium phenate detergent, 0.4% of a high conversion magnesium sulfonate detergent and 0.75% of a lower conversion magnesium sulfonate detergent was prepared. This composition had a viscosity increase slope of 0.126 cSt/hr.in the Mack T-7 test. This slope was indicative of failure of the test.

EXAMPLE 3

A lubricating oil formulation, with a TBN of 9.6 of which 8.5 TBN is contributed by the metallic detergents, was prepared containing a viscosity modifier, a pour point depressant, an antiwear agent, an antioxidant, an anti-foam agent, 5.2% of the succinimide dispersant of example A-11, 1.8% of a calcium phenate detergent, 0.4% of a high conversion magnesium sulfonate detergent 0.75% of a lower conversion magnesium sulfonate detergent, and an addition 0.6% (2.4 TBN) of an additional amount of a high conversion magnesium sulfonate detergent. This composition had a viscosity increase slope of 0.051 cSt/hr. in the Mack T-7 test. This slope indicates failure of the test, but an improvement over examples 1 and 2.

EXAMPLE 4

A lubricating oil formulation, with a TBN of 9.6 of which 8.5 TBN is contributed by the metallic detergents, was prepared containing a viscosity modifier, a pour point depressant, an antiwear agent, an antioxidant, an anti-foam agent, 5.2% of the succinimide dispersant of example A-11, 1.8% of a calcium phenate detergent, 0.4% of a high conversion magnesium sulfonate detergent, 0.75% of a lower conversion magnesium sulfonate detergent and 0.55% (2.4 T BN) of a high conversion sodium sulfonate detergent. This composition had a viscosity increase slope of 0.012 cSt/hr. in the Mack T-7 test. This slope indicates passing of the test.

EXAMPLE 5

A lubricating oil formulation, with a TBN of 9.5 of which 8.4 TBN is contributed by the metallic detergents, was prepared containing a viscosity modifier, a pour point depressant, an antiwear agent, an antioxidant, an anti-foam agent, 5.2% of the succinimide dispersant of example A-11, 1.8% of a calcium phenate detergent, 0.4% of a high conversion magnesium sulfonate detergent 0.75% of a lower conversion magnesium sulfonate detergent, and 0.9% (2.3 TBN) of a second high conversion calcium phenate detergent. This composition had a viscosity increase slope of 0.034 cSt/hr. in the Mack T-7 test. This slope indicates passing of the test.

EXAMPLE 6

A lubricating oil formulation, with a TBN of 9.6 of which 8.5 TBN is contributed by the metallic detergents, was prepared containing a viscosity modifier, a pour point depressant, an antiwear agent, an antioxidant, an anti-foam agent, 5.2% of the succinimide dispersant of example A-11, 1.8% of a calcium phenate detergent, 0.4% of a high conversion magnesium sulfonate detergent, 0.75% of a lower conversion magnesium sulfonate detergent, and a mixture of 0.35% (1.0 TBN) of a high conversion calcium sulfonate detergent plus 0.65% (1.4 TBN) of a high conversion potassium sulfonate detergent. This composition had a viscosity increase slope of 0.020 cSt/hr.in the Mack T-7 test. This slope indicates passing of the test.

EXAMPLE 7

A lubricating oil formulation, with a TBN of 9.7 of which 8.6 TBN is contributed by the metallic detergents, was prepared containing a viscosity modifier, a pour point depressant, an antiwear agent, an antioxidant, an anti-foam agent, 5.2% of the succinimide dispersant of example A-11, 1.8% of a calcium phenate detergent, 0.4% of a high conversion magnesium sulfonate detergent 0.75% of a lower conversion magnesium sulfonate detergent, and a mixture of 0.25% (0.8 TBN) of a high conversion calcium sulfonate detergent plus 0.4% (1.7 TBN) of a high conversion sodium sulfonate detergent. This composition had a viscosity increase slope of 0.021 cSt/hr. in the Mack T-7 test. This slope indicates passing of the test.

EXAMPLE 8

A lubricating oil formulation, with a TBN of 9.6 of which 8.5 TBN is contributed by the metallic detergents, was prepared containing a viscosity modifier, a pour point depressant, an antiwear agent, an antioxidant, an anti-foam agent, 5.2% of the succinimide dispersant of example A-11, 1.8% of a calcium phenate detergent, 0.4% of a high conversion magnesium sulfonate detergent 0.75% of a lower conversion magnesium sulfonate detergent, and 0.6% (2.4 TBN) of a high conversion calcium sulfonate detergent. This composition had a viscosity increase slope of 0.033 cSt/hr. in the Mack T-7 test. This slope indicates passing of the test.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

We claim:

1. A diesel lubricant having a TBN of about 6 to about 15, comprising a major amount of an oil of lubricating viscosity and a minor amount, sufficient to minimize undesirable viscosity increases of the lubricant when used in diesel engines, of a composition comprising (A) at least one carboxylic derivative composition produced by reacting at least one substituted succinic acylating agent with at least one amino compound containing at least one —NH— group wherein said acylating agent consists of substituent groups and succinic groups wherein the substituent groups are derived from polyalkene characterized by an Mn value of at least about 1200 and an Mw/Mn ratio of at least about 1.5, and wherein said acylating agents are characterized by the presence within their structure of an average of at least about 1.3 succinic groups for each equivalent weight of substituent groups, and (B) from about 0.5 to about 10% by weight of at least one basic alkali or alkaline earth metal salt of at least one acidic organic compound having a metal ratio of at least about 2, provided that the carboxylic derivative of component (A) contributes between about 0.5 and 1.5 TBN to the composition, and further provided that basic alkali or alkaline earth metal salt or salts of component (B) include a quantity of magnesium salt or salts such that the maganesium salt or salts contribute no more than about 30% of the TBN of the composition.

2. The lubricant of claim 1 containing at least about 0.8% sulfate ash.

3. The lubricant of claim 1 containing at least about 1% sulfate ash.

4. The lubricant of claim 1 wherein the substituent group in (A) is characterized by an Mn value of about 1300 to about 5000.

5. The lubricant of claim 1 wherein the substituent group in (A) is characterized by an Mw/Mn value of from about 1.5 to about 6.

6. The lubricant of claim 1 wherein the succinic groups correspond to the formula

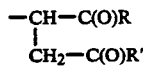

wherein R and R' are each independently selected from the group consisting of —OH, —Cl, —O-lower alkyl and, when taken together, R and R' are —O—, with the proviso that all the succinic groups need not be the same.

7. The lubricant of claim 1 wherein the substituent groups are derived from one or more polyalkene selected from the group consisting of homopolymers and interpolymers of terminal olefins of 2 to about 16 carbon atoms, with the proviso that said interpolymers can optionally contain up to about 40% of polymer units derived from internal olefins of up to about 16 carbon atoms.

8. The lubricant of claim 7 wherein said value of Mn is at least about 1500.

9. The lubricant of claim 7 wherein said value of Mw/Mn is at least about 1.8.

10. The lubricant of claim 1 wherein the substituent groups are derived from one or more polyalkene selected from the group consisting of homopolymers and interpolymers of terminal olefins of 2 to about 16 carbon atoms, with the proviso that said interpolymers can optionally contain up to about 25% of polymer units derived from internal olefins of up to about 16 carbon atoms.

11. The lubricant of claim 1 wherein the substituent groups are derived from a member selected from the group consisting of polybutene, ethylene- propylene copolymer, polypropylene, and mixtures of two or more of any of these.

12. The lubricant of claim 1 wherein said acylating agents are characterized by the presence within their structure of an average of at least 1.4 succinic groups for each equivalent weight of the substituent groups.

13. The lubricant of claim 1 wherein said value of Mn is about 1500 to about 2800.

14. The lubricant of claim 1 wherein said value of Mw/Mn is about 2.0 to about 3.4.

15. The lubricant of claim 1 wherein the acylating agents are characterized by the presence within their structure of at least 1.5 up to about 2.5 succinic groups for each equivalent weight of the substituent groups.

16. The lubricant of claim 11 wherein the substituent groups are derived from polybutene in which at least about 50% of the total units derived from butenes is derived from isobutene.

17. The lubricant of claim 1 wherein the succinic groups correspond to the formulae

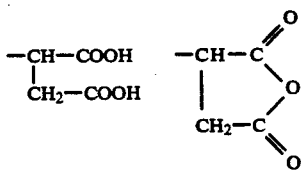

and mixtures of these.

18. The lubricant of claim 1 wherein the basic alkali or alkaline earth metal salt (B) is a salt of at least one sulfur acid, phosphorus acid, carboxylic acid or phenol or mixtures thereof.

19. The lubricant of claim 1 wherein the salt (B) is an is a salt of an organic sulfonic acid.

20. The lubricant of claim 19 wherein the sulfonic acid (i) is represented by the formulae $R'(SO_3H)_r$ or $(R^2)_xT(SO_3H)_y$ in which R' and $R^2$ are each independently an aliphatic group free from acetylenic unsaturation and containing up to 60 carbon atoms, T is an aromatic hydrocarbon nucleus, and x is a number of 1 to 3, and r and y are numbers of 1 to 4.

21. The lubricant of claim 20 wherein said sulfonic acid is an alkylated benzenesulfonic acid.

22. The lubricant of claim 19 wherein the basic sulfonate salt (B) is an oil-soluble dispersion prepared by the method which comprises contacting at a temperature between the solidification temperature of the reaction mixture and its decomposition temperature, (B-1) at least one acidic gaseous material selected from the group consisting of carbon dioxide, hydrogen sulfide, sulfur dioxide, and mixtures thereof, with (B-2) a mixture comprising (B-2-a) at least one oil-soluble sulfonic acid, or derivative thereof susceptible to overbasing;

(B-2-b) at least one alkali metal selected from the group consisting of lithium, sodium or potassium, or one or more basic compounds thereof selected from the group consisting of hydroxides, alkoxides, hydrides, or amides;

(B-2-c) at least one lower aliphatic alcohol selected from monohydric alcohols or dihydric alcohols, or at least one alkyl phenol or sulfurized alkyl phenol; and (B-2-d) at least one oil-soluble carboxylic acid or functional derivative thereof.

23. The lubricant of claim 22 wherein the acidic gaseous material (B-1) is carbon dioxide.

24. The lubricant of claim 22 wherein the sulfonic acid (B-2-a) is represented by the formulae $R'(SO_3H)_r$ or $(R^2)_xT(SO_3H)_y$ in which R' and $R^2$ are each independently an aliphatic group free from acetylenic unsaturation and containing up to 60 carbon atoms, T is an aromatic hydrocarbon nucleus, and x is a number of 1 to 3, and r and y are numbers of 1 to 4.

25. The lubricant of claim 22 wherein the functional derivatives of component (B-2-d) are selected from the group consisting of anhydrides, esters, amides, imides, amidenes and metal salts.

26. The lubricant of claim 22 wherein the ratios of equivalents of the components of B-2 are:

(B-2-b)/(B-2-a)—at least 4:1;

(B-2-c)/(B-2-a)—between about 1:1 and about 80:1;

(B-2-d)/(B-2-a)—between about 1:1 and about 1:20.

27. The lubricant of claim 22 wherein the basic salt (B) has a metal ratio of from about 6 to about 30.

28. A lubricant according to claim 22 wherein component (B-2-d) is at least one hydrocarbon- substituted succinic acid or functional derivative thereof and the reaction temperature is in the range of about 25°-200° C.

29. A lubricant according to claim 22 wherein component (B-2-a) is an alkylated benzenesulfonic acid.

30. A lubricant according to claim 22 wherein component (B-2-b) is sodium or a sodium compound.

31. A lubricant according to claim 22 wherein component (B-2-c) is at least one of methanol, ethanol, propanol, butanol and pentanol and component (B-2-d) is at least one of polybutenyl succinic acid and polybutenyl succinic anhydride wherein the polybutenyl group comprises principally isobutene units and has a number average molecular weight between about 700 and about 10,000.

32. The lubricant of claim 1 wherein the amino compound in (A) is an alkylene polyamine of the formula

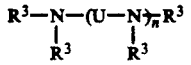

wherein U is an alkylene group of 2 to about 10 carbon atoms, each $R^3$ is independently a hydrogen atom, a lower alkyl group or a lower hydroxy alkyl group, with the proviso that at least one $R^3$ is a hydrogen atom, and n is 1 to about 10.

33. The lubricant of claim 1 wherein component (A) is at least one post-treated carboxylic derivative composition having been prepared by reacting said carboxylic derivative composition with one or more post-treating reagents selected from the group consisting of boron oxide, boron oxide hydrate, boron halides, boron acids, esters of boron acids, carbon disulfide, $H_2S$ sulfur, sulfur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds plus phenols, and sulfur plus phenols.

34. A method of operating diesel engines which comprises lubricating said engines during operation with the diesel lubricant of claim 1.

35. A method of operating diesel engines which comprises lubricating said engines during operation with the diesel lubricant of claim 22.

36. A method of operating diesel engines which comprises lubricating said engines during operation with the diesel lubricant of claim 32.

37. A method of operating diesel engines which comprises lubricating said engines during operation with the diesel lubricant of claim 33.

* * * * *